US008575828B2

(12) United States Patent
Kameda

(10) Patent No.: US 8,575,828 B2
(45) Date of Patent: Nov. 5, 2013

(54) SPARK PLUG

(75) Inventor: Hiroyuki Kameda, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 771 days.

(21) Appl. No.: 12/743,834

(22) PCT Filed: Nov. 20, 2008

(86) PCT No.: PCT/JP2008/071602
§ 371 (c)(1),
(2), (4) Date: May 20, 2010

(87) PCT Pub. No.: WO2009/066797
PCT Pub. Date: May 28, 2009

(65) Prior Publication Data

US 2010/0283373 A1 Nov. 11, 2010

(30) Foreign Application Priority Data

Nov. 20, 2007 (JP) ..... 2007-300824

(51) Int. Cl.
*H01T 13/20* (2006.01)

(52) U.S. Cl.
USPC ..... 313/141; 313/118

(58) Field of Classification Search
USPC ..... 313/118–145
See application file for complete search history.

(56) References Cited

U.S. PATENT DOCUMENTS

| | | | | |
|---|---|---|---|---|
| 4,700,103 | A | 10/1987 | Yamaguchi et al. | |
| 5,488,262 | A | 1/1996 | Takamura | |
| 5,502,351 | A | 3/1996 | Katoh et al. | |
| 5,556,315 | A * | 9/1996 | Kagawa | 445/7 |
| 6,215,235 | B1 * | 4/2001 | Osamura | 313/141 |
| 6,724,132 | B2 | 4/2004 | Kanao | |
| 7,084,558 | B2 | 8/2006 | Teramura et al. | |
| 7,321,187 | B2 | 1/2008 | Teramura et al. | |
| 2002/0021066 | A1 | 2/2002 | Kanao | |
| 2002/0050775 | A1 | 5/2002 | Hori | |
| 2002/0067111 | A1 | 6/2002 | Shibata et al. | |

(Continued)

FOREIGN PATENT DOCUMENTS

| | | | |
|---|---|---|---|
| JP | 61-45583 | A | 3/1986 |
| JP | 5-166577 | A | 7/1993 |

(Continued)

*Primary Examiner* — Anh Mai
*Assistant Examiner* — Andrew Coughlin
(74) *Attorney, Agent, or Firm* — Sughrue Mion, PLLC

(57) ABSTRACT

A corner of a distal end of a ground-electrode-side noble metal tip of a spark plug is taken as a first corner; a corner of a leading end of a center-electrode-side noble metal tip is taken as a second corner; a corner formed at a starting point where a diameter of the center electrode is reduced is taken as a third corner; a corner of the ground electrode is taken as a fourth corner; a corner closest to the third corner of the corners on the distal end of the ground-electrode-side noble metal tip is taken as a fifth corner; a length of a virtual flying spark path defined between the first corner and the second corner is taken as L1; a length of a virtual flying spark path defined between the third corner and the fourth corner is taken as L2; a length of a virtual flying spark path defined between the third corner and the fifth corner is taken as L3; and L2 or L3, whichever is shorter, is taken as L4, the spark plug fulfills a relational expression of L4/L1≥1.1.

14 Claims, 17 Drawing Sheets

(56) References Cited

U.S. PATENT DOCUMENTS

| | | | | |
|---|---|---|---|---|
| 2002/0093277 | A1 | 7/2002 | Hiramatsu | |
| 2003/0085643 | A1* | 5/2003 | Matsubara | 313/141 |
| 2004/0041506 | A1 | 3/2004 | Teramura et al. | |
| 2004/0092193 | A1 | 5/2004 | Musasa et al. | |
| 2006/0238092 | A1 | 10/2006 | Teramura et al. | |

FOREIGN PATENT DOCUMENTS

| | | | |
|---|---|---|---|
| JP | 5-198348 | A | 8/1993 |
| JP | 6-310256 | A | 11/1994 |
| JP | 7022157 | A | 1/1995 |
| JP | 8213149 | A | 8/1996 |
| JP | 11-121142 | A | 4/1999 |
| JP | 2002033176 | A | 1/2002 |
| JP | 2002-83662 | A | 3/2002 |
| JP | 2002-289321 | A | 10/2002 |
| JP | 2002-324650 | A | 11/2002 |
| JP | 2004-22450 | A | 1/2004 |
| JP | 3497015 | B2 | 2/2004 |
| JP | 2004-127916 | A | 4/2004 |
| JP | 2007-172866 | A | 7/2007 |
| WO | 0265604 | A1 | 8/2002 |

* cited by examiner

OPPOSED VOLUME V = V1+V2

SPARK PLUG

TECHNICAL FIELD

The present invention relates to a spark plug.

BACKGROUND ART

For example, a spark plug disclosed in Patent Document 1 has been known as a spark plug whose radial direction is taken as a direction of discharge (hereinafter also called "plug of lateral discharge type").

(JP-A-2002-83662, JP-B-3497015, and the like)

In order to suppress a flame-extinguishing action on flame kernel, as one kind of related-art spark plug, there is provided a spark plug in which a noble metal tip is welded to each of a leading end of a center electrode and a distal end of a ground electrode. When a noble metal tip is welded to an end of an electrode, if a difference between the diameter of the electrode and the diameter of the noble metal tip is large, it is difficult to perform balanced welding, which may deteriorate a welding strength. For this reason, in order to make the diameter of the center electrode close to the diameter of the noble metal tip, there is often adopted a structure in which the diameter of the center electrode is reduced toward a leading end thereof. However, since an angular part is formed at a starting point where the diameter of the center electrode is reduced, there is a problem, in the related-art plug of the lateral discharge type, of occurrence of a case where electric discharge occurs between the angular part formed at the starting point where the diameter of the center electrode is reduced and the ground electrode.

The present invention has an object thereof to provide a technique for a plug of lateral discharge type capable of suppressing occurrence of electric discharge in portions other than a normal discharge path.

DISCLOSURE OF THE INVENTION

The present invention has been conceived to solve at least a part of the aforementioned problems and can be implemented as aspects or application examples provided below.

A spark plug of the present invention comprises: a center electrode extending in an axial direction of the spark plug; a center-electrode-side noble metal tip joined to a leading end of the center electrode; a ground electrode opposing a side surface of the center-electrode-side noble metal tip; and a ground-electrode-side noble metal tip joined to a distal end of the ground electrode, wherein: of corners of a distal end of the ground-electrode-side noble metal tip, a corner closest toward a leading end direction of the center-electrode-side noble metal tip is taken as a first corner; of corners of the leading end of the center-electrode-side noble metal tip, a corner closest to the ground-electrode-side noble metal tip is taken as a second corner; of corners formed at a starting point where a diameter of the center electrode is reduced, a corner closest to the ground electrode is taken as a third corner; of the corners of the ground electrode, a corner closest to the third corner is taken as a fourth corner; of the corners on the distal end of the ground-electrode-side noble metal tip, a corner closest to the third corner is taken as a fifth corner; a virtual flying spark path established between any two of the corners is defined, on condition that: a line passing through a vertex of one corner and bisecting the one corner is taken as a first line, a line passing through a vertex of another corner and bisecting the another corner is taken as a second line, a circular arc tangent to the first line and having end points at the vertex of the one corner and the vertex of the another corner is taken as a first circular arc, and a circular arc tangent to the second line and having end points at the vertex of the one corner and the vertex of the another corner is taken as a second circular arc, as a combination of: a path extending along the first circular arc which connects the vertex of the one corner to a middle point of the first circular arc; a straight path that connects the middle point of the first circular arc to a middle point of the second circular arc; and a path extending along the second circular arc which connects the middle point of the second circular arc to the vertex of the another corner; and a relational expression of $L4/L1 \geq 1.1$ is fulfilled on condition that: a length of a virtual flying spark path defined between the first corner and the second corner is taken as L1, a length of a virtual flying spark path defined between the third corner and the fourth corner is taken as L2, a length of a virtual flying spark path defined between the third corner and the fifth corner is taken as L3, and L2 or L3, whichever is shorter, is taken as L4.

The spark plug can inhibit development of electric discharge from a path other than a normal discharge path. It becomes unnecessary, as countermeasures for inhibiting occurrence of flying sparks along a path other than the normal path, to increase the length of the noble metal tip on the center electrode and the length of the noble metal tip on the ground electrode, to thus increase direct distances among the corners. Therefore, the length of the noble metal tip on the center electrode and the length of the noble metal tip on the ground electrode can be reduced, so that cost of the spark plug can be curtailed.

In the spark plug, the first corner and the second corner are configured such that a first half line extending from the vertex of the first corner as a starting point toward an outside of the first corner and bisecting the first corner and a second half line extending from the vertex of the second corner as a starting point toward an outside of the second corner and bisecting the second corner cross each other; the third corner and the fourth corner are configured, when $L2 \leq L3$, such that a third half line extending from the vertex of the third corner as a starting point toward an outside of the third corner and bisecting the third corner and a fourth half line extending from the vertex of the fourth corner as a starting point toward an outside of the fourth corner and bisecting the fourth corner do not cross each other; and the third corner and the fifth corner are configured, when $L3 < L2$, such that the third half line and a fifth half line extending from the vertex of the fifth corner as a starting point toward an outside of the fifth corner and bisecting the fifth corner do not cross each other.

In accordance with the spark plug, flying sparks become easy to develop between the first corner and the second corner, which makes it easy to induce normal discharge. Further, development of flying sparks between the third corner and the fourth corner and development of flying sparks between the third corner and the fifth corner can be inhibited.

Another spark plug of the present invention comprises: a center electrode extending in an axial direction of the spark plug; a center-electrode-side noble metal tip joined to a leading end of the center electrode; a ground electrode opposing a side surface of the center-electrode-side noble metal tip; and a ground-electrode-side noble metal tip joined to a distal end of the ground electrode, wherein of corners of a distal end of the ground-electrode-side noble metal tip, a corner closest toward a leading end direction of the center-electrode-side noble metal tip is taken as a first corner; of corners of a leading end of the center-electrode-side noble metal tip, a corner closest to the ground-electrode-side noble metal tip is taken as a second corner; of R-chamfered portions formed at a starting point where a diameter of the center electrode is reduced, an R-chamfered portion closest to the ground electrode is taken as a first R-chamfered portion; a virtual corner formed by a point of intersection of two lines sandwiching the first R-chamfered portion and the two lines is taken as a third corner; of R-chamfered portions made between a distal end and a side surface of the ground electrode, an R-chamfered portion closest to the third corner is taken as a second R-chamfered portion; a virtual corner formed by a point of intersection of two lines sandwiching the second R-chamfered portion and the two lines is taken as a fourth corner; of corners of a distal end of the ground-electrode-side noble metal tip, a corner closest to the third corner is taken as a fifth corner; a virtual flying spark path established between any two of the corners is defined, on condition that: a line passing through a vertex of one corner and bisects the one corner is taken as a first line, a line passing through a vertex of another corner and bisects the another corner is taken as a second line, a circular arc tangent to the first line and having end points at the vertex of the one corner and the vertex of the another corner is taken as a first circular arc, and a circular arc tangent to the second line and having end points at the vertex of the one corner and the vertex of the another corner is taken as a second circular arc, as a combination of: a path extending along the first circular arc which connects the vertex of the one corner to a middle point of the first circular arc; a straight path that connects a middle point of the first circular arc to a middle point of the second circular arc; and a path extending along the second circular arc which connects the middle point of the second circular arc to the vertex of the another corner; and a relational expression of $L4/L1 \geq 0.9$ is fulfilled, and a curvature radius of the first R-chamfered portion and a curvature radius of the second R-chamfered portion are 0.1 mm or more, on condition that: a length of a virtual flying spark path defined between the first corner and the second corner is taken as L1, a length of a virtual flying spark path defined between the third corner and the fourth corner is taken as L2, a length of a virtual flying spark path defined between the third corner and the fifth corner is taken as L3, and L2 or L3, whichever is shorter, is taken as L4.

The spark plug can inhibit development of electric discharge from a path other than a normal discharge path.

In yet another spark plug of the present invention comprises: a center electrode extending in an axial direction of the spark plug; a center-electrode-side noble metal tip joined to a leading end of the center electrode; a ground electrode opposing a side surface of the center-electrode-side noble metal tip; and a ground-electrode-side noble metal tip joined to a distal end of the ground electrode, wherein: of corners of a distal end of the ground-electrode-side noble metal tip, a corner closest toward a leading end direction of the center-electrode-side noble metal tip is taken as a first corner; of corners of a leading end of the center-electrode-side noble metal tip, a corner closest to the ground-electrode-side noble metal tip is taken as a second corner; of R-chamfered portions formed at a starting point where a diameter of the center electrode is reduced, an R-chamfered portion closest to the ground electrode is taken as a first R-chamfered portion; a virtual corner formed by a point of intersection of two lines sandwiching the first R-chamfered portion and the two lines is taken as a third corner; of R-chamfered portions formed between a distal end and a side surface of the ground electrode, an R-chamfered portion closest to the third corner is taken as a second R-chamfered portion; a virtual corner formed of a point of intersection of two lines sandwiching the second R-chamfered portion and the two lines is taken as a fourth corner; of corners on a distal end of the ground-electrode-side noble metal tip, a corner closest to the third corner is taken as a fifth corner; a virtual flying spark path established between any two of the corners is defined, on condition that: a line passing through a vertex of one corner and bisecting the one corner is taken as a first line, a line passing through a vertex of another corner and bisecting the another corner is taken as a second line, a circular arc tangent to the first line and having end points at the vertex of the one corner and the vertex of the another corner is taken as a first circular arc, and a circular arc tangent to the second line and having end points at the vertex of the one corner and the vertex of the another corner is taken as a second circular arc, as a combination of: a path extending along the first circular arc which connects the vertex of the one corner to a middle point of the first circular arc; a straight path that connects a middle point of the first circular arc to a middle point of the second circular arc; and a path extending along the second circular arc which connects the middle point of the second circular arc to the vertex of the another corner; a relational expression of $L4/L1 \geq 1.0$ is fulfilled on condition that: a length of a virtual flying spark path defined between the first corner and the second corner is taken as L1, a length of a virtual flying spark path defined between the third corner and the fourth corner is taken as L2, a length of a virtual flying spark path defined between the third corner and the fifth corner is taken as L3, and L2 or L3, whichever is shorter, is taken as L4; and a curvature radius of the first R-chamfered portion and a curvature radius of the second R-chamfered portion are 0.05 mm or more.

The spark plug can further inhibit development of electric discharge from a path other than a normal discharge path.

In the spark plug, the curvature radius of the first R-chamfered portion and the curvature radius of the second R-chamfered portion may be 0.1 mm or more.

The spark plug can inhibit occurrence of electric discharge from a path other than a normal discharge path.

In the spark plug, on condition that: a virtual plane parallel to the distal end of the ground-electrode-side noble metal tip which overlaps the center-electrode-side noble metal tip and spaced 0.1 mm away from a point on the center-electrode-side noble metal tip closest to the distal end of the ground-electrode-side noble metal tip is taken as a first virtual plane, a volume of a discharge contribution portion that is a part of the center-electrode-side noble metal tip to be cut by the first virtual plane and that overlaps the distal end of the ground-electrode-side noble metal tip when the center-electrode-side noble metal tip is projected on the distal end of the ground-electrode-side noble metal tip is taken as V1, a virtual plane parallel to the distal end of the ground-electrode-side noble metal tip, which overlaps the ground-electrode-side noble metal tip and spaced 0.1 mm away from the distal end of the ground-electrode-side noble metal tip is taken as a second virtual plane, and a volume of a discharge contribution portion that is a part of the ground-electrode-side noble metal tip to be cut by the second virtual plane and that overlaps the discharge contribution portion when the discharge contribution portion is projected on the distal end of the ground-electrode-side noble metal tip is taken as V2, a relational expression of $V1+V2 \geq 0.015\ mm^3$ is fulfilled.

The spark plug can inhibit generation of wear in the center-electrode-side noble metal tip and wear in the ground-electrode-side noble metal tip. An increase in gap that is the shortest distance between the center-electrode-side noble metal tip and the ground-electrode-side noble metal tip can be inhibited, and durability of the electrodes can be enhanced.

The first corner and the fifth corner may be configured such that a line extending from the third corner along the axial direction of the spark plug does not cross the ground-electrode-side noble metal tip.

The spark plug can inhibit development of a fuel bridge between the corner made at a starting point where the diameter of the center electrode is reduced and the ground electrode, which would otherwise be caused as a result of adhesion of fuel, and leakage of an electric current.

The third corner may also become exposed from a leading end of a substantially-cylindrical insulator provided on an outer periphery of the center electrode.

The spark plug can inhibit development of a fuel bridge between carbon adhering to the center electrode and the leading end of the insulator and the ground electrode, which would otherwise arise as a result of adhesion of fuel in a state where carbon adheres to the leading end of the insulator, and leakage of an electric current.

In the spark plug, on condition that: a fused portion is formed between the center electrode and the center-electrode-side noble metal tip, of corners formed in a boundary portion between the center electrode and the fused portion, a corner closest to the ground electrode is taken as a sixth corner, a length of a virtual flying spark path established between the fourth corner and the sixth corner is taken as L5, a length of a virtual flying spark path established between the fifth corner and the sixth corner is taken as L6, and L5 or L6, whichever is shorter, is taken as L7, a relational expression of L7/L4≥0.5 is fulfilled.

The spark plug can further inhibit development of electric discharge from a path other than a normal discharge path.

In the spark plug, on condition that: a fused portion is formed between the center electrode and the center-electrode-side noble metal tip, an angle achieved in a boundary portion between the center-electrode-side noble metal tip and the fused portion is taken as θ1, and an angle achieved in a boundary portion between the fused portion and the center electrode is taken as θ2, a relational expression of θ1>θ2 and a relational expression of θ1<180° are fulfilled.

The spark plug can enhance heat conduction from the center-electrode-side noble metal tip to the center electrode.

The present invention can be implemented in various modes. For instance, the present invention can be implemented in forms; for instance, a method for manufacturing a spark plug, a manufacturing apparatus, a manufacturing system, and the like.

BEST MODE FOR CARRYING OUT THE INVENTION

Embodiments of a spark plug as one mode of the present invention will now be described in the following sequence.

Figure 1:
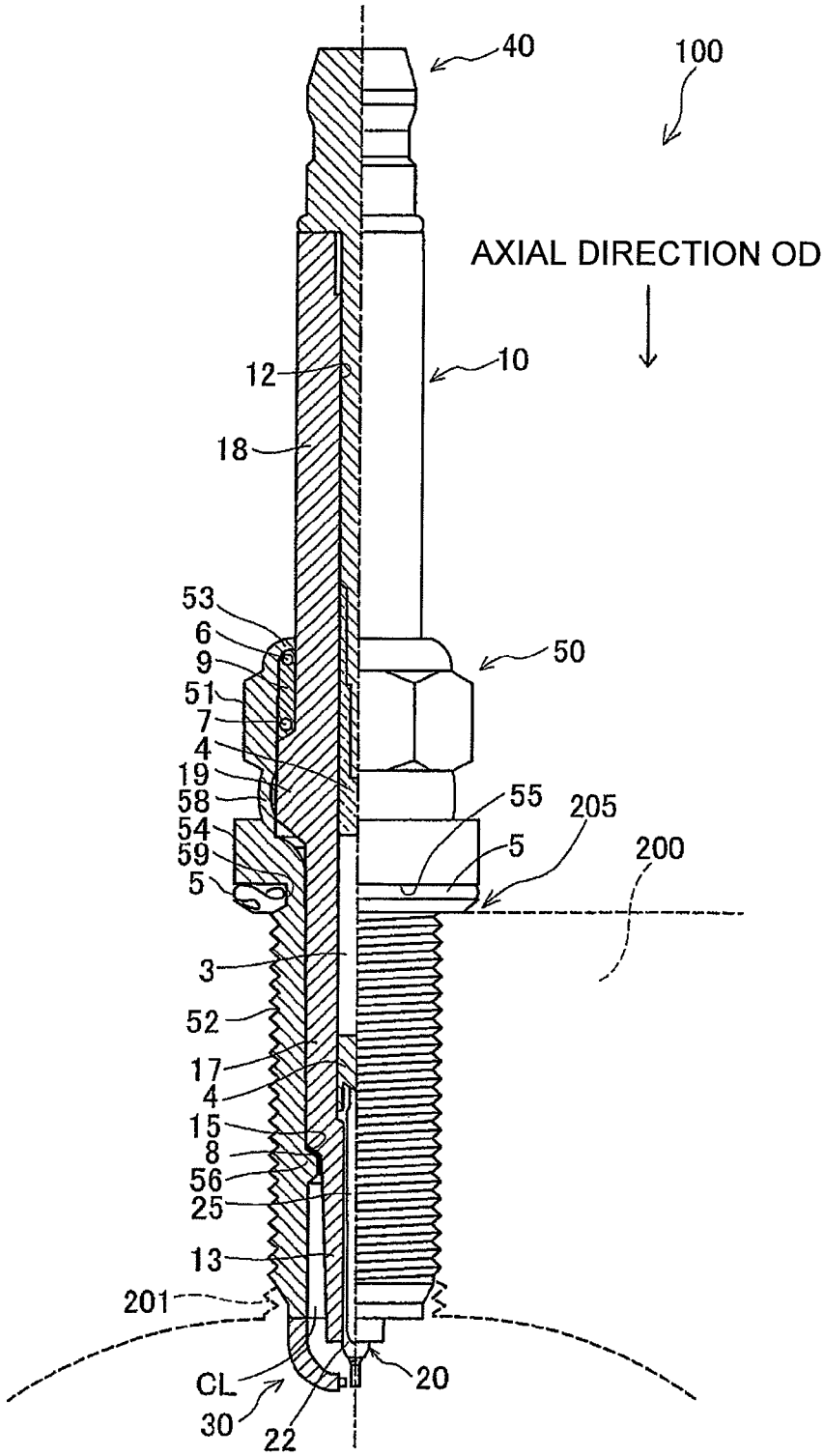
FIG. 1 is a partial cross-sectional view of a spark plug 100 according to an embodiment of the present invention.

A. Structure of a spark plug:

B. Shape and dimension of each part:

C. An example test on a flying spark path ratio Lr:

D. An example test on a curvature radius of an R-chamfered portion:

E. An example test on an opposed volume V:

F. Modification:

A. Structure of a Spark Plug:

FIG. 1 is a partial cross-sectional view of a spark plug 100 according to an embodiment of the present invention. In FIG. 1, an axial direction OD of the spark plug 100 is taken as a vertical direction of the drawing, and a lower side and a upper side in the drawing are respectively referred to as a leading end side and a base end side of the spark plug 100.

The spark plug 100 includes an insulator 10, a metal shell 50, a center electrode 20, a ground electrode 30, and a terminal metal fitting 40. The center electrode 20 is held such that the center electrode extends in an axial direction OD within the insulator 10. The insulator 10 functions as an insulating element, and the metal shell 50 holds the insulator 10. The terminal metal fitting 40 is provided at a base end of the insulator 10. The structure of the center electrode 20 and the ground electrode 30 is described in detail with reference to FIG. 2.

The insulator 10 is made by sintering aluminum, or the like, and has a cylindrical shape in which an axial hole 12 extending in the axial direction OD is formed at the axial center of the insulator 10. A flange 19 having the largest outer diameter is provided at the substantial center in the axial direction OD, and a base-end barrel 18 is formed at a position closer to the base end (the upper side in FIG. 1). A leading-end barrel 17 whose outer diameter is smaller than that of the rear-end barrel 18 is formed at a position closer to the leading end (the lower side in FIG. 1) with respect to the flange 19, and a leg 13 whose outer diameter is smaller than that of the leading-end barrel 17 is formed at a position further closer to the leading end with respect to the leading-end barrel 17. The diameter of the leg 13 is reduced toward its leading end. When the spark plug 100 is mounted on an engine head 200 of an internal combustion engine, the leg 13 is exposed to a combustion chamber of the engine. A step 15 is formed between the leg 13 and the leading-end barrel 17.

The metal shell 50 is a cylindrical metal fitting made of a low carbon steel material and fastens the spark plug 100 to the engine head 200 of the internal combustion engine. The metal shell 50 holds therein an insulator 10, and a portion of the insulator 10 from a part of the base-end barrel 18 to the leg 13 is surrounded by the metal shell 50.

The metal shell 50 includes a tool engagement portion 51 and a mount screw 52. The tool engagement portion 51 is a portion around which a spark plug wrench (not shown) fits. The mount screw 52 of the metal shell 50 is a portion where a thread is formed; and is screw-engaged with an attachment screw hole 201 of the engine head 200 provided in an upper portion of the internal combustion engine.

A flange-shaped seal 54 is formed between the tool engagement portion 51 and the mount screw 52 of the metal shell 50. An annular gasket 5 formed by bending a plate element is fitted to a screw neck 59 located between the mount screw 52 and the seal 54. When the spark plug 100 is attached to the engine head 200, the gasket 5 becomes collapsed and deformed between a bearing surface 55 of the seal 54 and an opening circumference 205 of the mount screw hole 201. As a result of deformation of the gasket 5, a space between the spark plug 100 and the engine head 200 is sealed, whereupon leakage of internal airtightness of the engine, which would otherwise occur by way of the mount screw hole 201, is prevented.

A thin clamping portion 53 is provided at a position close to a base end with respect to the tool engagement portion 51 of the metal shell 50. A thin buckling portion 58 is provided between the seal 54 and the tool engagement portion 51 as in the case with the clamping portion 53. Annular ring members 6, 7 are interposed between an internal periphery from the tool engagement portion 51 of the metal shell 50 to the clamping portion 53 and an outer periphery of the base-end barrel 18 of the insulator 10. A space between the ring members 6, 7 is filled with powder of talc (talc) 9. When the clamping portion 53 is clamped so as to become inwardly bent, the insulator 10 is pressed toward the leading end within the metal shell 50 by way of the ring members 6, 7 and the talc 9. As a result, the step 15 of the insulator 10 is supported by a step 56 formed along an internal periphery of the metal shell 50 and becomes integral with the metal shell 50 and the insulator 10. Airtightness existing between the metal shell 50 and the insulator 10 is maintained by an annular plate packing 8 interposed between the step 15 of the insulator 10 and the step 56 of the metal shell 50, whereby outflow of a combustion gas is prevented. The buckling portion 58 is configured so as to become outwardly deflected and deformed by adding compressive force at the time of clamping operation, and gains a compression stroke of the talc 9, thereby increasing internal airtightness of the metal shell 50. Clearance CL of predetermined dimension is provided between the insulator 10 and a portion of the metal shell 50 closer to the leading end with respect to the step 56.

Figure 2:
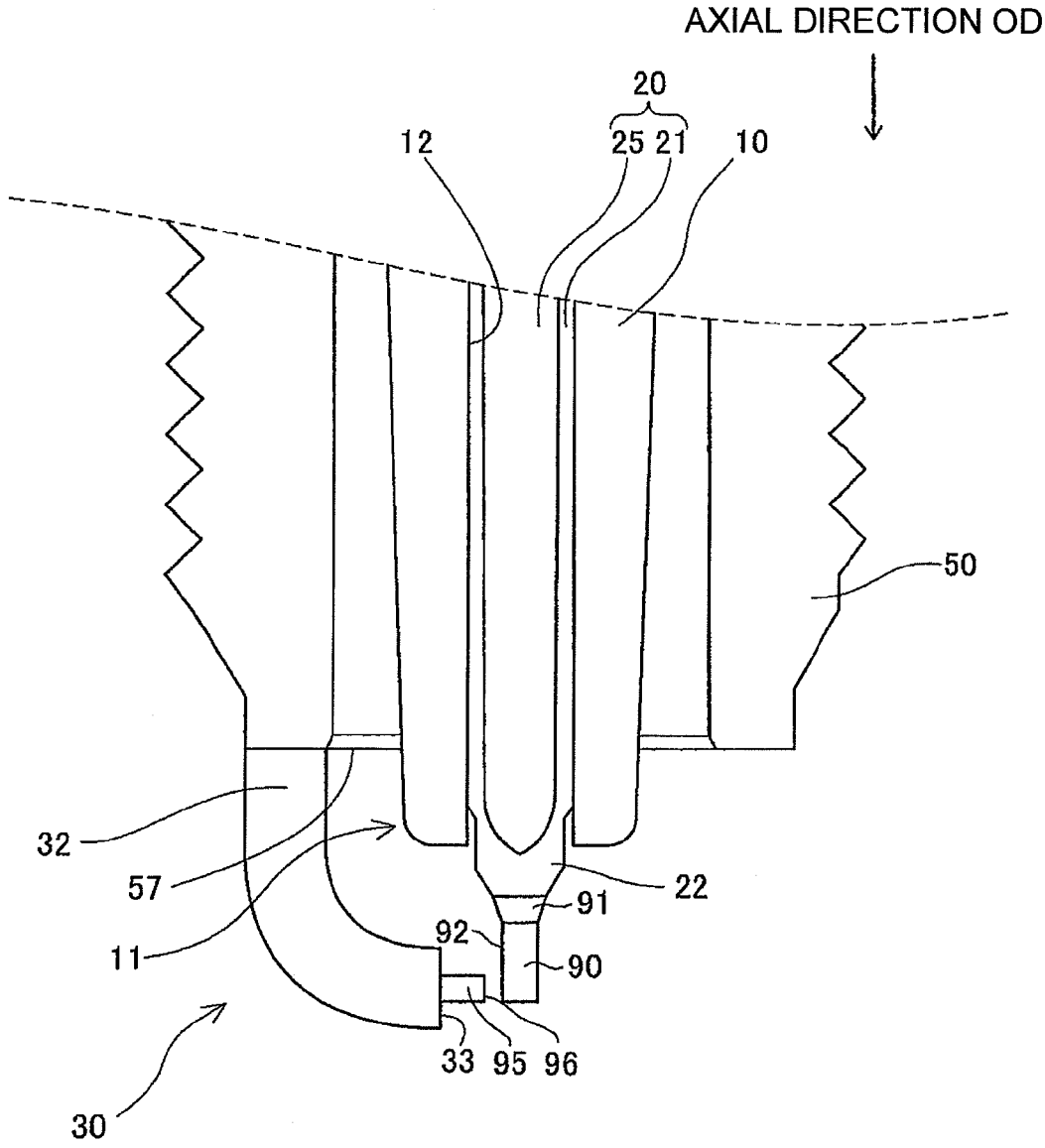
FIG. 2 is an enlarged view of a vicinity of a leading end 22 of a center electrode 20 of the spark plug 100.

FIG. 2 is an enlarged view of a vicinity of the leading end 22 of the center electrode 20 of the spark plug 100. The center electrode 20 is a rod-shaped electrode having a structure in which a core member 25 is embedded in an electrode base member 21. The electrode base member 21 is made of nickel or an alloy containing nickel as a main component, such as Inconel (trade name) 600 or 601. The core member 25 is made of copper, which exhibits superior heat conductivity than does the electrode base member 21, or an alloy containing copper as a main component. The center electrode 20 is usually made by filling the inside of the electrode base member 21, which is formed into a bottomed cylindrical shape, with a core member 25, and by pulling a bottom side of the electrode base member 21 by means of extrusion molding. A barrel of the core member 25 has a substantially-constant outer diameter, but a diameter-reduced part is formed on a leading-end side of the core member 25. The center electrode 20 extends toward the base end within the axial hole 12 and electrically connected to the terminal metal fitting 40 (FIG. 1) by way of a sealing element 4 and a ceramic resistor 3 (FIG. 1). A high-voltage cable (not shown) is connected to the terminal metal fitting 40 by way of a plug cap (not shown), and a high voltage is applied to the terminal metal fitting 40.

The leading end 22 of the center electrode 20 protrudes than does a leading end 11 of the insulator 10. A center electrode tip 90 is joined to an end of the leading end 22 of the center electrode 20 by way of a fused portion 91 formed by laser welding. The center electrode tip 90 has a substantially-columnar shape extending in an axial direction OD and is made of noble metal with high melting point in order to enhance spark wear resistance. The center electrode tip 90 is made, for example, iridium (Ir) or an Ir alloy containing Ir as a main component and additive selected from one kind or two kinds or more of platinum (Pt), rhodium (Rh), ruthenium (Ru), palladium (Pd), and rhenium (Re).

The ground electrode 30 is made of metal with highly corrosion resistant, for example, a nickel alloy such as Inconel (trademark) 600 and 601. A base 32 of the ground electrode 30 is joined to a leading end 57 of the metal shell 50 by means of welding. The ground electrode 30 is bent, and a distal end 33 of the ground electrode 30 opposes a side surface 92 of the center electrode tip 90.

Further, a ground electrode tip 95 is joined to the distal end 33 of the ground electrode 30. The ground electrode tip 95 has a substantially-columnar shape essentially perpendicular to the axial direction OD, and a distal end 96 of the ground electrode tip 95 opposes the side surface 92 of the center electrode tip 90. The ground electrode tip 95 is made of the same material as that of the center electrode tip 90.

Figure 3A:
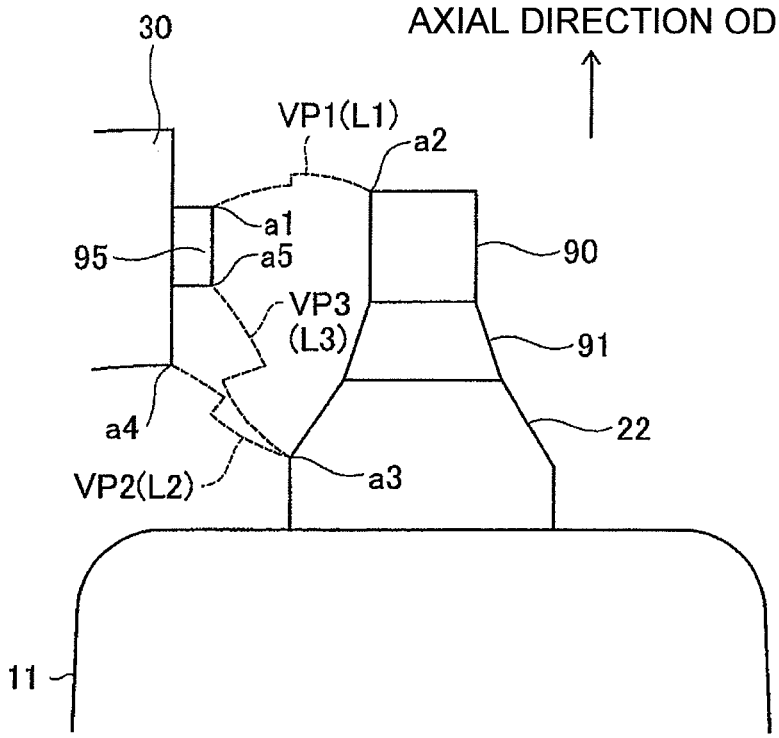
FIGS. 3(A), (B) are further enlarged diagrams showing the leading end 22 of the center electrode 20.
Figure 3B:
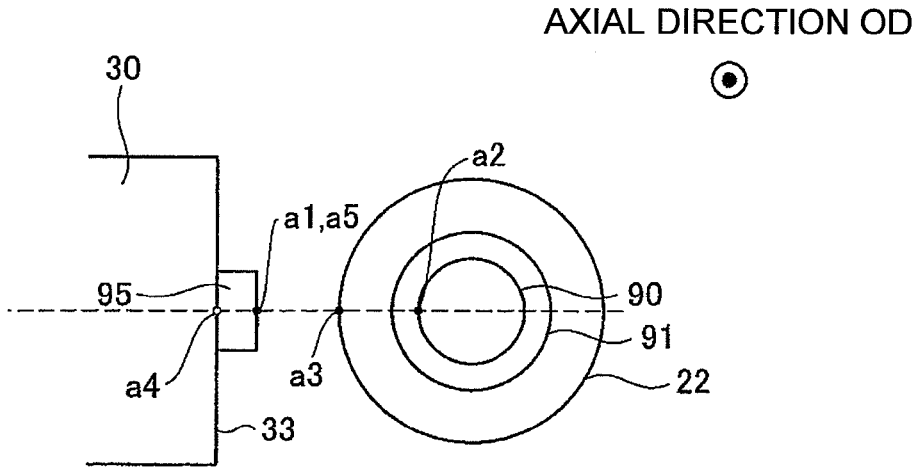

B. Shape and Dimension of Each Portion:

FIG. 3(A) is a further enlarged diagram showing the leading end 22 of the center electrode 20. FIG. 3(B) is a view of a vicinity of the leading end of the spark plug 100 when viewed in the axial direction. The leading end 11 of the insulator 10 is omitted from FIG. 3(B). Three virtual flying spark paths VP1, VP2, and VP3 are drawn in FIG. 3(A). The virtual flying spark paths are conceivable virtual paths that are considered to act as paths along which flying sparks fly when flying sparks develop out of respective corners. The first virtual flying spark path VP1 is a virtual path achieved when flying sparks develop out of a portion between a corner a1 of the ground electrode tip 95 and a corner a2 of the center electrode tip 90. The second virtual flying spark path VP2 is a virtual path achieved when flying sparks develop out of a portion between a corner a3 of the center electrode 20 and a corner a4 of the ground electrode 30. The third virtual flying spark path VP3 is a virtual path achieved when flying sparks develop out of a portion between the corner a3 of the center electrode 20 and a corner a5 of the ground electrode tip 95. Definitions of the three virtual flying spark paths VP1, VP2, and VP3 will be described later.

The corner a1 is, among corners of the distal end of the ground electrode tip 95, a corner located closest toward in a leading end direction of the center electrode tip 90 (in the axial direction OD shown in FIG. 3(A)). Of the corners of the leading end of the center electrode tip 90, the corner a2 is a corner closest to the ground electrode tip 95.

Among corners formed at a starting point where the diameter of the center electrode 20 is reduced, the corner a3 is a corner located closest to the ground electrode 30. The reason for reducing the diameter of the center electrode 20 is for welding the center electrode tip 90 to the center electrode 20 in a well-balanced manner by reducing a difference between the diameter of the leading end 22 of the center electrode 20 and the diameter of the center electrode tip 90. Among the corners of the ground electrode 30, the corner a4 is a corner located closest to the corner a3. Of the corners of the distal end of the ground electrode tip 95, the corner a5 is a corner located closest to the corner a3. The corner a4 shown in FIG. 3(B) is actually situated on the back of the ground electrode 30.

In the spark plug of lateral discharge type, normal discharge is expected to develop between the ground electrode tip 95 and the center electrode tip 90. Specifically, it is desirable that electric discharge develops between the corner a1 and the corner a2 along the virtual flying spark path VP1. However, if a length L2 of the second virtual flying spark path VP2 is shorter than a length L1 of the first virtual flying spark path VP1, electric discharge will occur between the corner a3 and the corner a4 along the second virtual flying spark path VP2. Likewise, if a length L3 of the third virtual flying spark path VP3 is shorter than the length L1 of the first virtual flying spark path VP1, electric discharge will occur between the corner a3 and the corner a5 along the third virtual flying spark path VP3. Therefore, in order to cause electric discharge between the corner a1 and the corner a2 along the virtual flying spark path VP1, it is preferable that the length L2 of the second virtual flying spark path VP2 and the length L3 of the third virtual flying spark path VP3 is longer than the length L1 of the first virtual flying spark path VP1.

In a case where the length L2 of the second virtual flying spark path VP2 and the length L3 of the third virtual flying spark path VP3 are compared with each other and where the shorter length is defined as L4, it is desirable that the spark plug will fulfill Expression (1) provided below.

$$L4/L1 \geq 1.1 \quad (1)$$

where L4=min(L2, L3).

Grounds for the definition will be described in detail below. L4/L1 is hereinafter defined as a flying spark path ratio Lr.

So long as the spark plug is configured so as to fulfill Expression (1), occurrence of flying sparks along the second virtual flying spark path VP2 or the third virtual flying spark path VP3 can be inhibited. It becomes unnecessary, as countermeasures for inhibiting occurrence of flying sparks along a path other than the normal path, to make the length of the center electrode tip 90 and the length of the ground electrode tip 95 long, to thus increase direct distances among the corners. Therefore, the length of the center electrode tip 90 and the length of the ground electrode tip 95 can be reduced, so that cost of the spark plug can be curtailed.

Figure 4A:
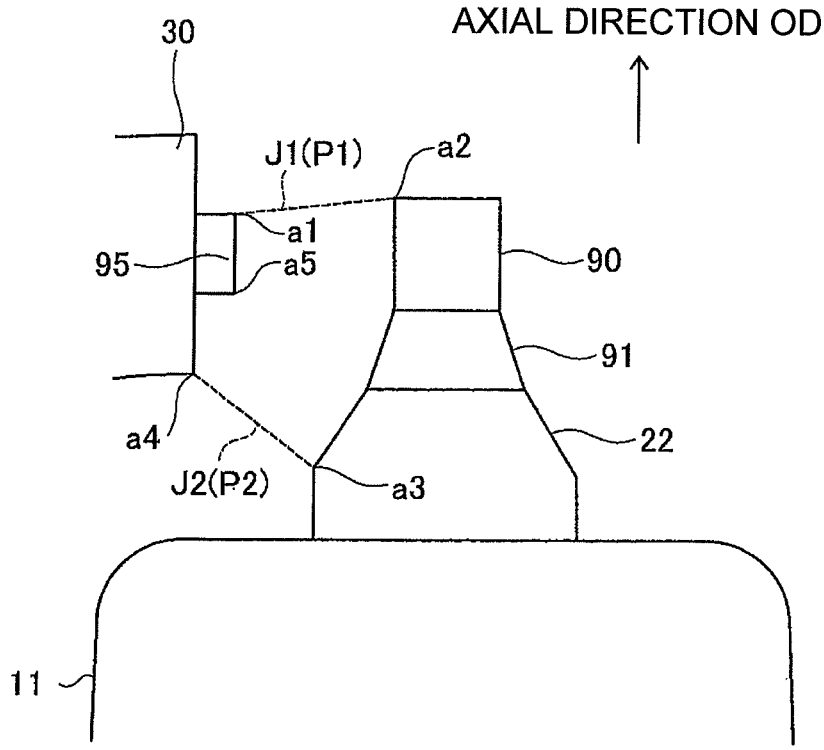
FIGS. 4(A), (B) are diagrams showing linear paths J1, J2.
Figure 4B:
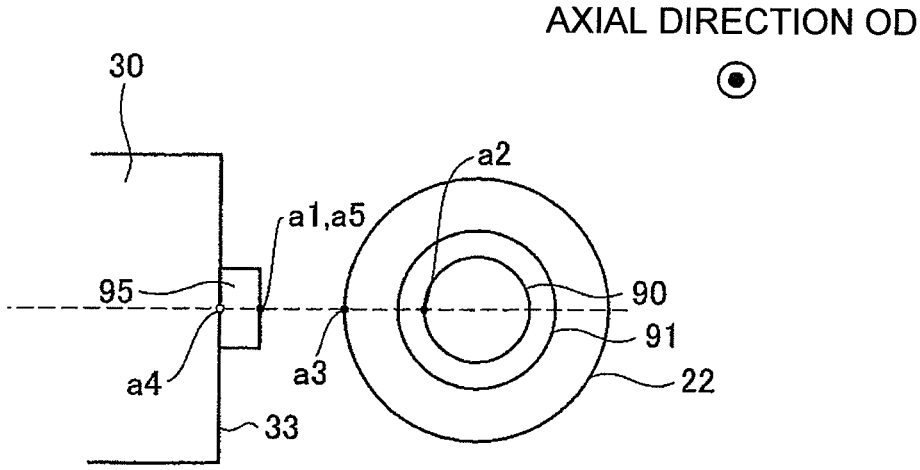

FIGS. 4(A), (B) are diagrams of straight paths J1, J2. So long as the spark plug satisfies Relational Expression (1), occurrence of flying sparks between the corner a3 and the corner a4 is inhibited even when a relationship, such as that expressed by Expression (2) provided below, exists between a length P1 of the straight path J1 straightforwardly interconnecting the corner a1 and the corner a2 and a length P2 of a straight path J2 straightforwardly interconnecting the corner a3 and the corner a4, as shown in FIG. 4(A).

$$P2/P1 \leq 1.1 \quad (2)$$

Specifically, occurrence of flying sparks can be understood to be dependent not on the direct distance between the corners but on the lengths of the virtual flying spark paths VP1 to VP3.

Figure 5:
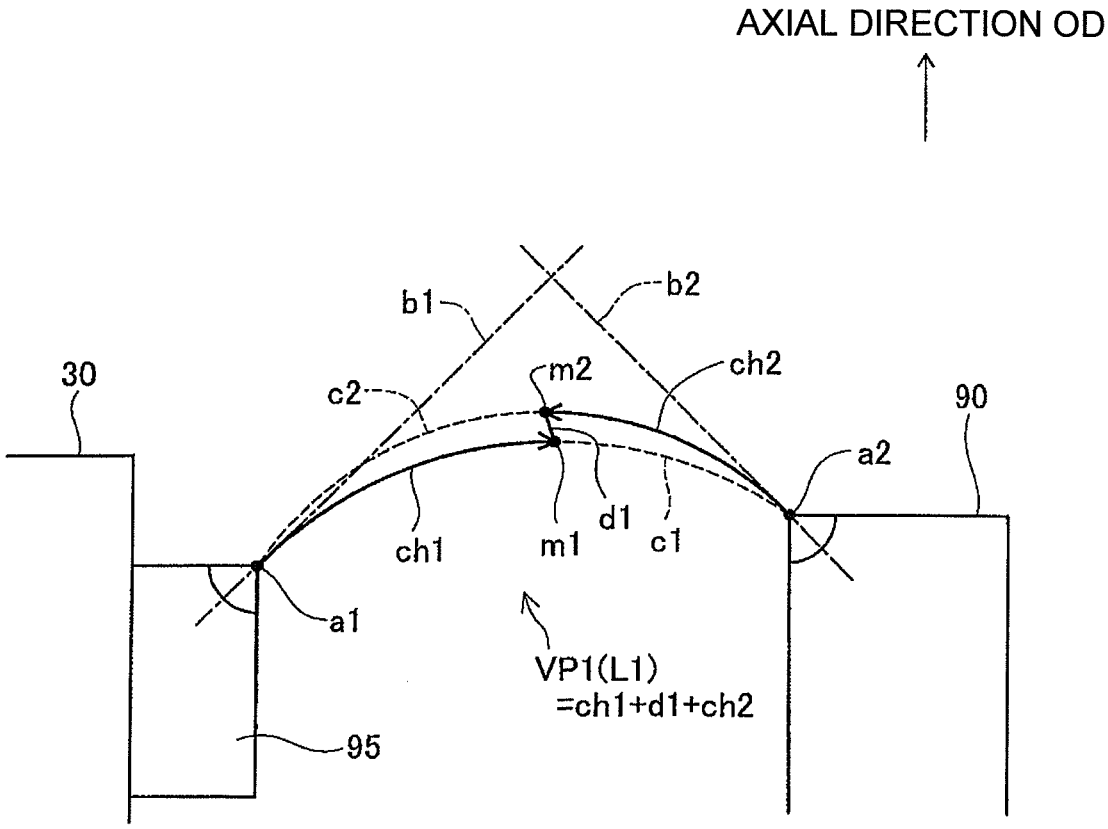
FIG. 5 is a diagram pertaining to the definition of a first virtual flying spark path VP1.

FIG. 5 is a diagram pertaining to a definition of the first virtual flying spark path VP1. States of the two corners a1, a2 cut along a single vertical cross section are shown. First, there is drawn a half line b1 that is located along a line bisecting the angle of the corner a1 and that extends outwards from the corner a1. Likewise, there is drawn a half line b2 that is located along a line bisecting the angle of the corner a2 and that extends outwards from the corner a2. There is next drawn a circular arc c1 that is tangent to the half line b1 and that has endpoints at the vertex of the corner a1 and the vertex of the corner a2. Likewise, there is drawn a circular arc c2 that is tangent to the half line b2 and that has endpoints at the vertex of the corner a1 and the vertex of the corner a2.

A path running along a part of the circular arc c1 connecting the vertex of the corner a1 to a middle point m1 of the circular arc c1 is taken as a path ch1. A straight path connecting the middle point m1 of the circular arc c1 to a middle point m2 of the circular arc c2 is taken as a path d1. Further, a path running along the circular arc c2 connecting the middle point m2 of the circular arc c2 to the vertex of the corner a2 is taken as a path ch2. A path connecting the path ch1, the path d1, and the path ch2 is defined as the first virtual flying spark path VP1.

Grounds for defining the first virtual flying spark path VP1 as mentioned above are now described. Flying sparks developing out of the spark plug are likely to originate from the corner of the electrode tip onto which an electric field is concentrated. Flying sparks are considered to be emitted along a line that bisects one corner and to reach to another corner along a circular arc. Since flying sparks are caused respectively in two corners, there are two conceivable paths (the circular arc c1 and the circular arc c2) depending on the corners where the flying sparks are made. Therefore, the first virtual flying spark path VP1 set in consideration of the two paths can be considered to most accurately represent an actual path of flying sparks. The same also applies to the second virtual flying spark path VP2 and the third virtual flying spark path VP3 provided below.

Depending on the arrangement of the corners a1 and a2, the half lines b1, b2 may not cross each other in midair. However, the corner a1 and the corner a2 are preferably configured such that the half lines b1, b2 cross each other in midair. With such a configuration, flying sparks become easier to occur between the corner a1 and the corner a2, which in turn makes it easy to induce normal electric discharge.

Figure 6:
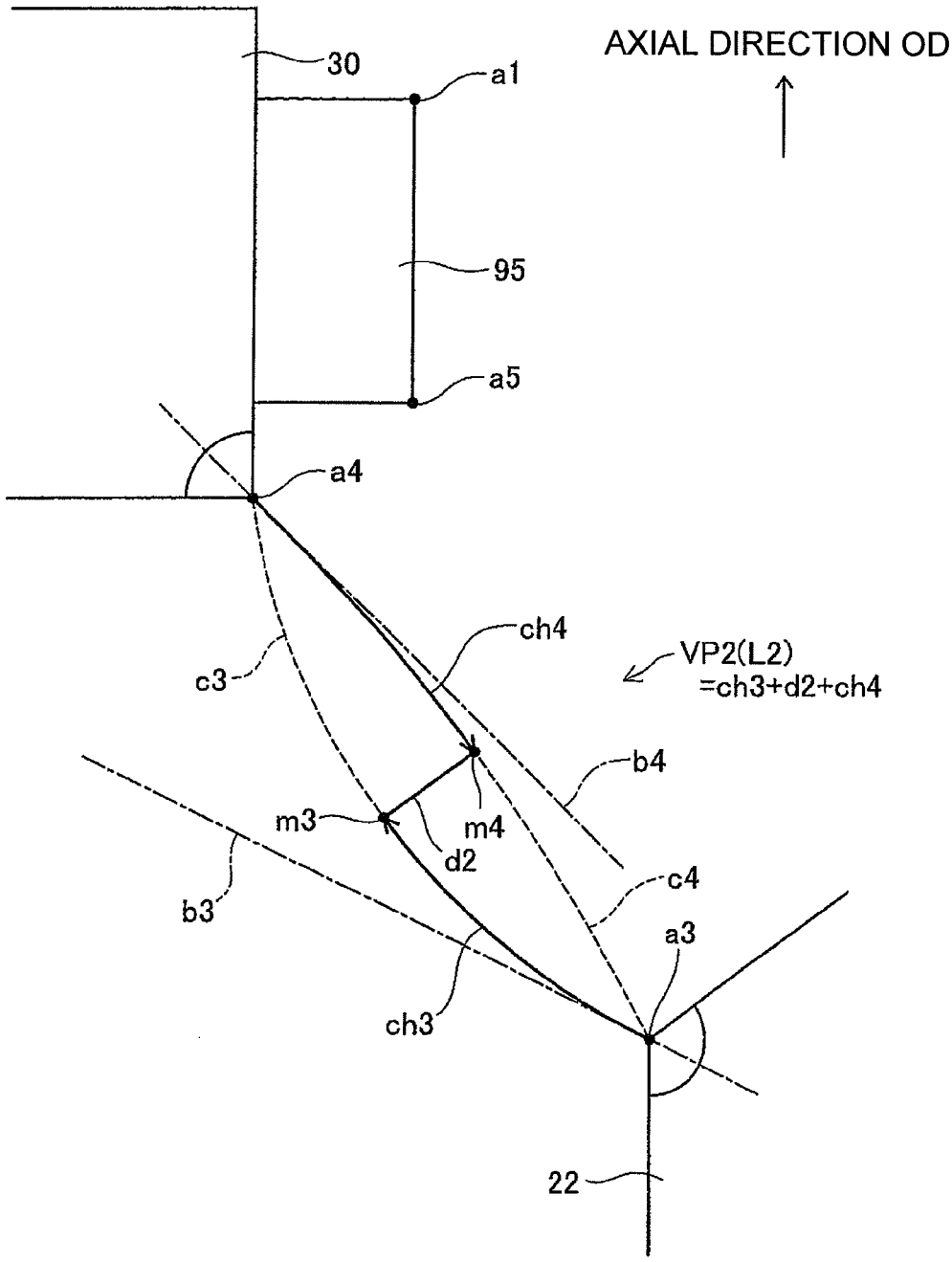
FIG. 6 is a diagram pertaining to the definition of a second virtual flying spark path VP2.

FIG. 6 is a diagram pertaining to the definition of the second virtual flying spark path VP2. The second virtual flying spark path VP2 is defined in a manner similar to the first virtual flying spark path VP1. Specifically, there is first drawn a half line b3 that is located along a line bisecting the angle of the corner a3 and that extends outwards from the corner a3. Likewise, there is drawn a half line b4 that is located along a line bisecting the angle of the corner a4 and that extends outwards from the corner a4. There is next drawn a circular arc c3 that is tangent to the half line b3 and that has endpoints at the vertex of the corner a3 and the vertex of the corner a4. Likewise, there is drawn a circular arc c4 that is tangent to the half line b4 and that has endpoints at the vertex of the corner a3 and the vertex of the corner a4. A path running along a part of the circular arc c3 connecting the vertex of the corner a3 to a middle point m3 of the circular arc c3 is taken as a path ch3. A straight path connecting the middle point m3 of the circular arc c3 to a middle point m4 of the circular arc c4 is taken as a path d2. Further, a path running along a part of the circular arc c4 connecting the middle point m4 of the circular arc c4 to the vertex of the corner a4 is taken as a path ch4. A path connecting the path ch3, the path d2, and the path ch4 is defined as the second virtual flying spark path VP2.

Figure 7:
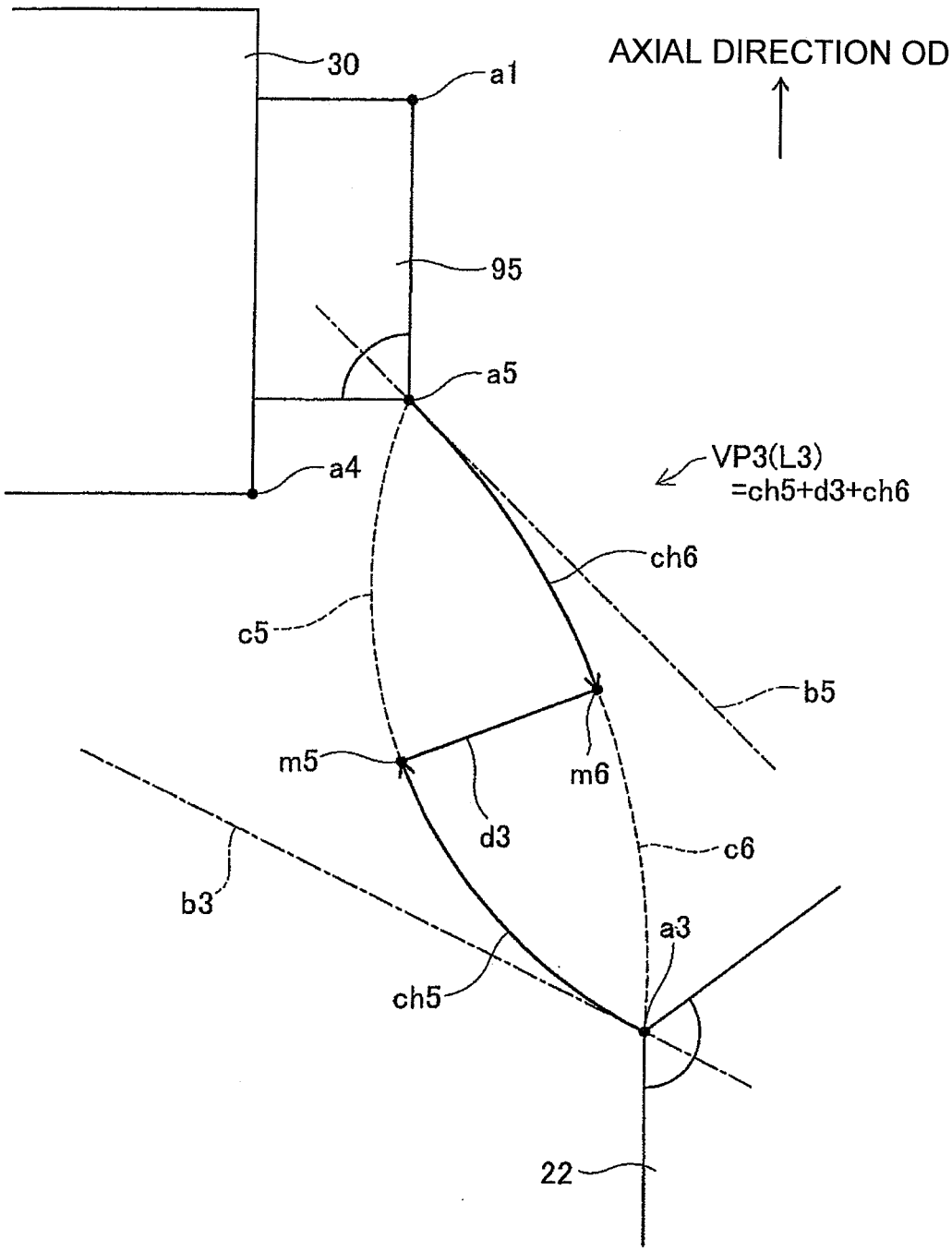
FIG. 7 is a diagram pertaining to the definition of a third virtual flying spark path VP3.

FIG. 7 is a diagram pertaining to the definition of the third virtual flying spark path VP3. The third virtual flying spark path VP3 is defined in a manner similar to the first virtual flying spark path VP1 and the second virtual flying spark path VP2. Specifically, there is first drawn a half line b3 that is located along a line bisecting the angle of the corner a3 and that extends outwards from the corner a3. Likewise, there is drawn a half line b5 that is located along a line bisecting the angle of the corner a5 and that extends outwards from the corner a5. There is next drawn a circular arc c5 that is tangent to the half line b3 and that has endpoints at the vertex of the corner a3 and the vertex of the corner a5. Likewise, there is drawn a circular arc c6 that is tangent to the half line b5 and that has endpoints at the vertex of the corner a3 and the vertex of the corner a5. A path running along a part of the circular arc c5 connecting the vertex of the corner a3 to a middle point m5 of the circular arc c5 is taken as a path ch5. A straight path connecting the middle point m5 of the circular arc c5 to a middle point m6 of the circular arc c6 is taken as a path d3. Further, a path running along a part of the circular arc c6 connecting the middle point m6 of the circular arc c6 to the vertex of the corner a5 is taken as a path ch6. A path connecting the path ch5, the path d3, and the path ch6 is defined as the third virtual flying spark path VP3.

When a relational expression of $L2 \leq L3$ is satisfied, the corner a3 and the corner a4 are preferably configured such that the half line b3 and the half line b4 do not cross each other (see FIG. 6). Since the path of the second virtual flying spark path VP2 can be made long by the above configurations, occurrence of flying sparks between the corner a3 and the corner a4 can be inhibited.

Further, when a relational expression of $L3 < L2$ is satisfied, the corner a3 and the corner a5 are preferably configured such that the half line b3 and the half line b5 do not cross each other (see FIG. 7). Since the path of the third virtual flying spark path VP3 can be made long by the above configurations, occurrence of flying sparks between the corner a3 and the corner a5 can be inhibited.

Figure 8A:
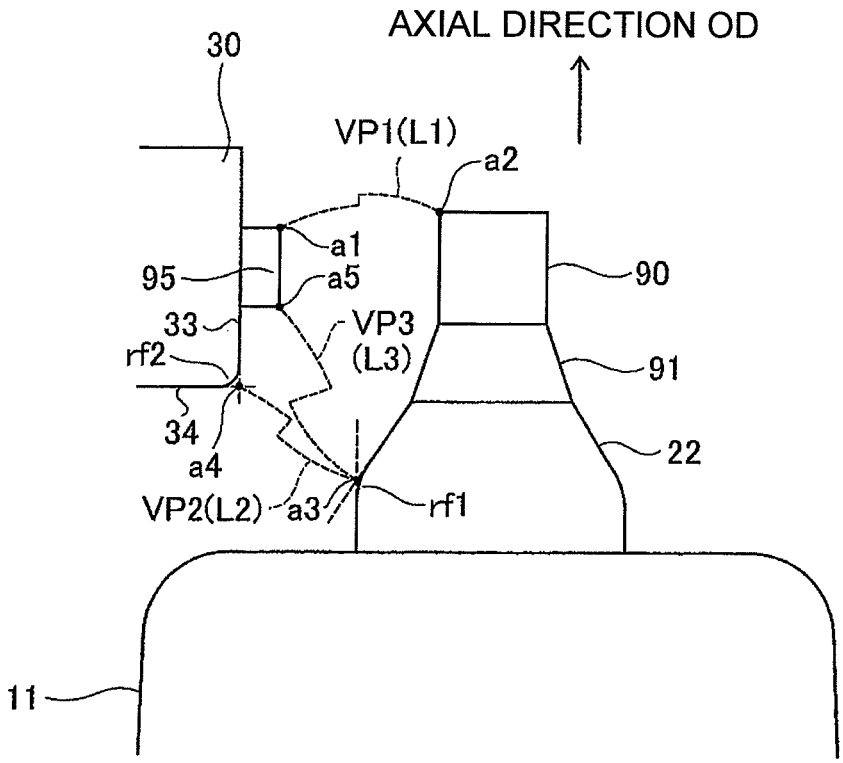
FIGS. 8(A), (B) are diagrams showing another example in a vicinity of a leading end of the spark plug 100.
Figure 8B:
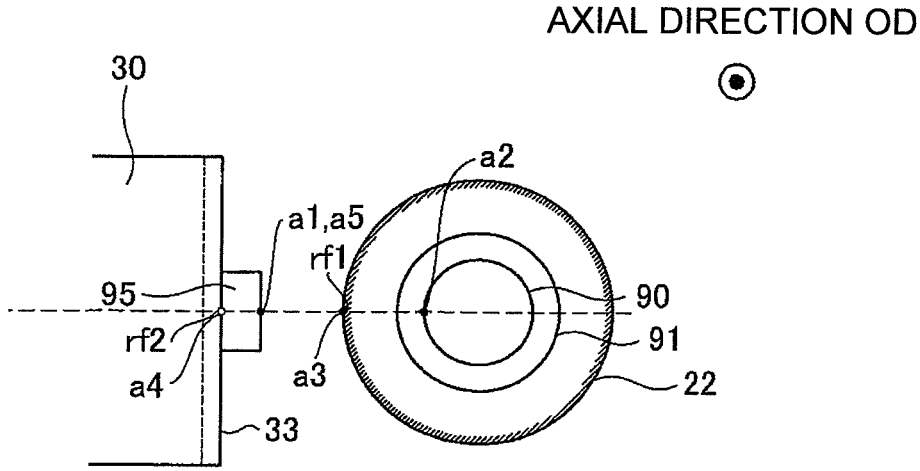

FIG. 8(A) is a diagram showing another example in a vicinity of the leading end of the spark plug 100. FIG. 8(B) is a view of the vicinity of the leading end of the spark plug 100 when viewed from an axial direction. The leading end 11 of the insulator 10 is omitted from FIG. 8(B). A difference from the vicinity of the leading end of the spark plug 100 shown in FIG. 3 is that the corner a3 and the corner a4 are subjected to so-called R-chamfering. Of R-chamfered portions annularly formed at a starting point where the diameter of the center electrode is reduced (hatched portions in FIG. 8(B)), an R-chamfered portion rf1 formed in the corner a3 is an R-chamfered portion located closest to the ground electrode. In this case, the corner a3 is a virtual corner configured by two lines having the R-chamfered portion rf1 sandwiched therebetween and a point of intersection of the two lines. Of R-chamfered portions formed between a distal end 33 and a side face 34 of the ground electrode, an R-chamfered portion rf2 formed in the corner a4 is an R-chamfered portion located closest to the corner a3. In this case, the corner a4 is a virtual corner configured by two lines having the R-chamfered portion rf2 sandwiched therebetween and a point of intersection of the two lines. The corner a4 and the R-chamfered portion rf2 shown in FIG. 8(B) are actually situated on the back of the ground electrode 30.

Figure 9:
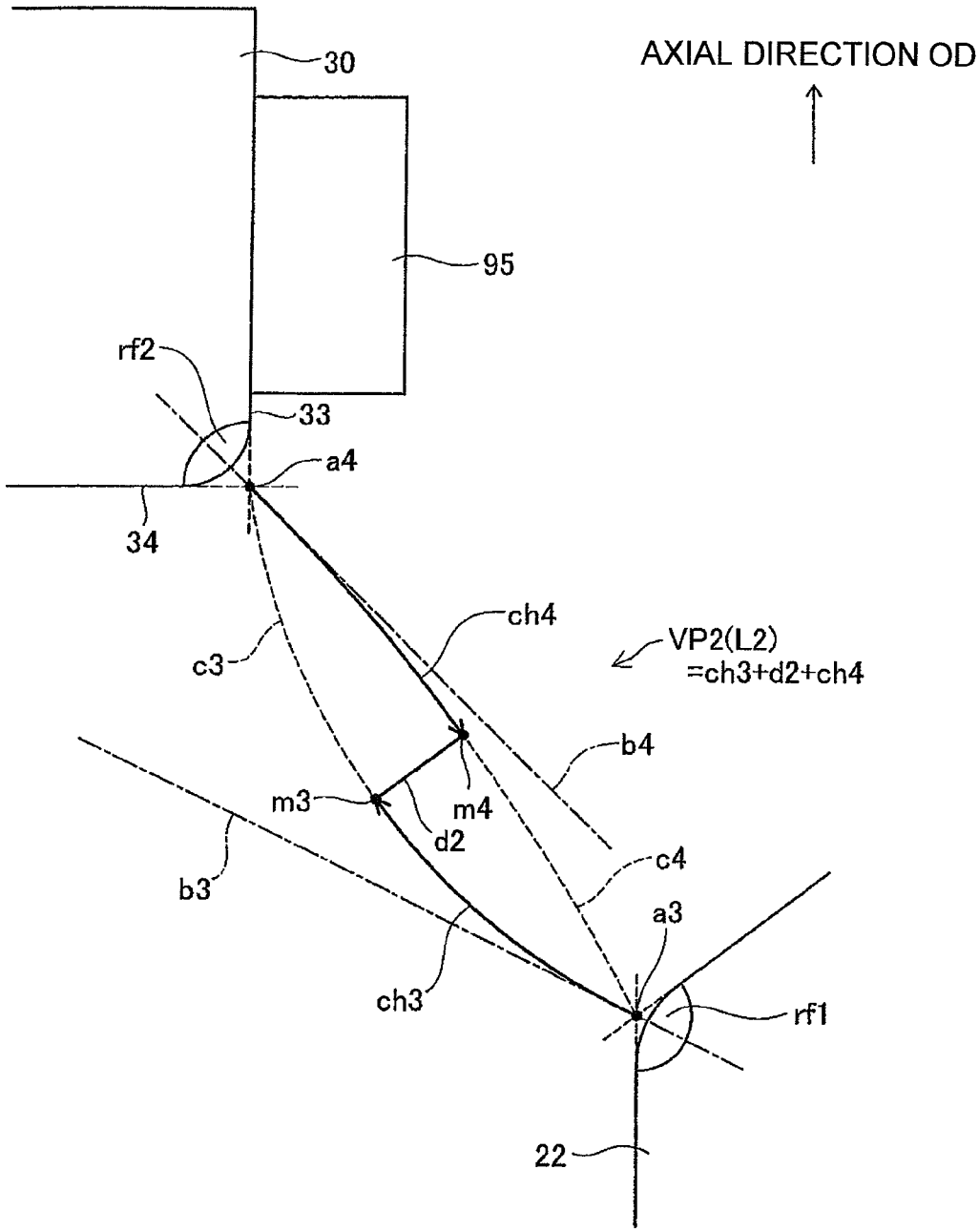
FIG. 9 is a diagram pertaining to a definition of the second virtual flying spark path VP2 achieved when corners a3 and a4 are R-chamfered.

FIG. 9 is a diagram pertaining to the definition of the second virtual flying spark path VP2 achieved when the corners a3, a4 are subjected to R-chamfering. As shown in FIG. 9, even when the corners a3, a4 having undergone R-chamfering, the second virtual flying spark path VP2 is defined from the virtually-drawn corner a3 toward the virtually-drawn corner a4, as in the case of FIG. 6. As mentioned above, the length L2 of the second virtual flying spark path VP2 and the length L3 of the third virtual flying spark path VP3 (FIG. 8) are compared with each other, and a shorter length is taken as L4.

As mentioned above, when the corners a3, a4 are subjected to R-chamfering, electric field becomes less likely to concentrate on the R-chamfered portions rf1, rf2. Hence, a discharge voltage for inducing electric discharge between the R-chamfered portion rf1 and the R-chamfered portion rf2 becomes high. Specifically, even when the length L2 of the second virtual flying spark path VP2 is made shorter than the length of its counterpart of a spark plug (FIG. 3) in which the corners are not subjected to R-chamfering, flying sparks become less likely to arise between the R-chamfered portion rf1 and the R-chamfered portion rf2.

Accordingly, in order to inhibit occurrence of flying sparks at a portion other than the space between the corner a1 and the corner a2 in the spark plug having the structure shown in FIG. 8, it is preferable that the spark plug fulfills Relational expression (3) provided below and that a curvature radius of the R-chamfered portion rf1 and a curvature radius of the R-chamfered portion rf2 are 0.1 mm or more.

$$L4/L1 \geq 0.9 \quad (3)$$

where $L4 = \min(L2, L3)$. The same also applies to any counterparts in the following descriptions.

Further, it is preferable that the spark plug fulfills Relational expression (4) provided below and that a curvature radius of the R-chamfered portion rf1 and a curvature radius of the R-chamfered portion rf2 are 0.05 mm or more.

$$L4/L1 \geq 1.0 \quad (4)$$

Moreover, it is preferable that the spark plug will fulfill Relational expression (5) provided below and that a curvature radius of the R-chamfered portion rf1 and a curvature radius of the R-chamfered portion rf2 each assume a value of 0.1 mm or more.

$$L4/L1 \geq 1.0 \quad (5)$$

Grounds for the above definition will be described in detail below.

So long as the spark plug is configured as mentioned above, occurrence of flying sparks along the second virtual flying spark path VP2 or the third virtual flying spark path VP3 can be inhibited. The length of the center electrode tip 90 and the length of the ground electrode tip 95 can be made short, so that cost of the spark plug can be curtailed.

Figure 10:
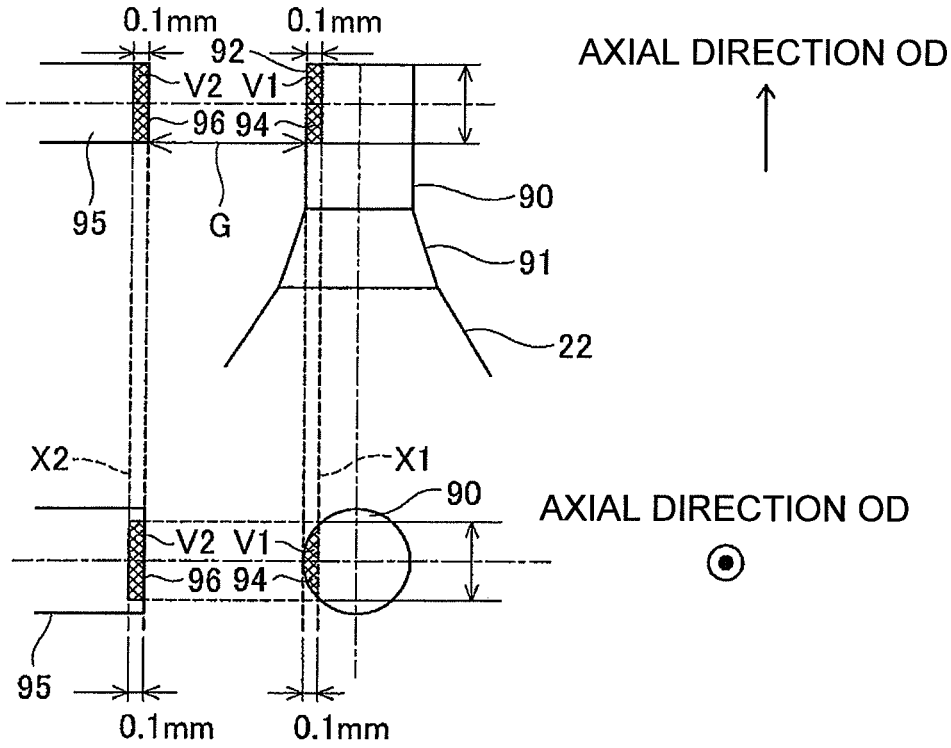
FIG. 10 is a diagram showing a relationship between a center electrode tip 90 and a ground electrode tip 95.

FIG. 10 is a diagram showing a preferable projective relationship between the center electrode tip 90 and the ground electrode tip 95. FIG. 10 shows a virtual plane X1 and a virtual plane X2. The virtual plane X1 is a virtual plane that is parallel to the distal end 96 of the ground electrode tip 95; that overlaps the center electrode tip 90; and that is spaced 0.1 mm away from the point of the center electrode tip 90 closest to the distal end 96 of the ground electrode tip 95. Moreover, the virtual plane X2 is a virtual plane parallel to the distal end 96 of the ground electrode tip 95; namely, a virtual plane that overlaps the ground electrode 95 and is spaced 0.1 mm apart from the distal end 96 of the ground electrode tip 95.

The volume of a discharge contribution portion 94, which is a portion of the center electrode tip 90 cut by the virtual plane X1 and which overlaps the distal end 96 of the ground electrode tip 95 when the center electrode tip 90 is projected on the distal end 96 of the ground electrode tip 95, is taken as V1. The volume of a portion, which is a portion of the ground electrode tip 95 cut by the virtual plane X2 and which overlaps the discharge contribution portion 94 of the center electrode tip 90 when the discharge contribution portion 94 of the center electrode tip 90 is projected on the distal end 96 of the ground electrode tip 95, is taken as V2. A result of addition of V1 and V2 is defined as an opposed volume V. FIG. 10 shows a gap G that connects the ground electrode tip 95 to the center electrode tip 90 by the shortest distance.

When the opposed volume V is small, wear in the side surface 92 of the center electrode tip 90 due to electric discharge quickly progresses, and an increase in gap G also progresses quickly. The increase in gap G incurs an increase in discharge voltage. Therefore, in order to inhibit an increase in discharge voltage, it is preferable that the opposed volume V is as large as possible. Specifically, it is preferable that the opposed volume V is defined so as to fulfill Relational Expression (6) provided below.

$$V \geq 0.015\ \text{mm}^3 \tag{6}$$

Grounds for the definition will later be described in detail.

So long as the spark plug is configured so as to fulfill Relational Expression (6), an increase in gap G can be prevented.

Figure 11A:
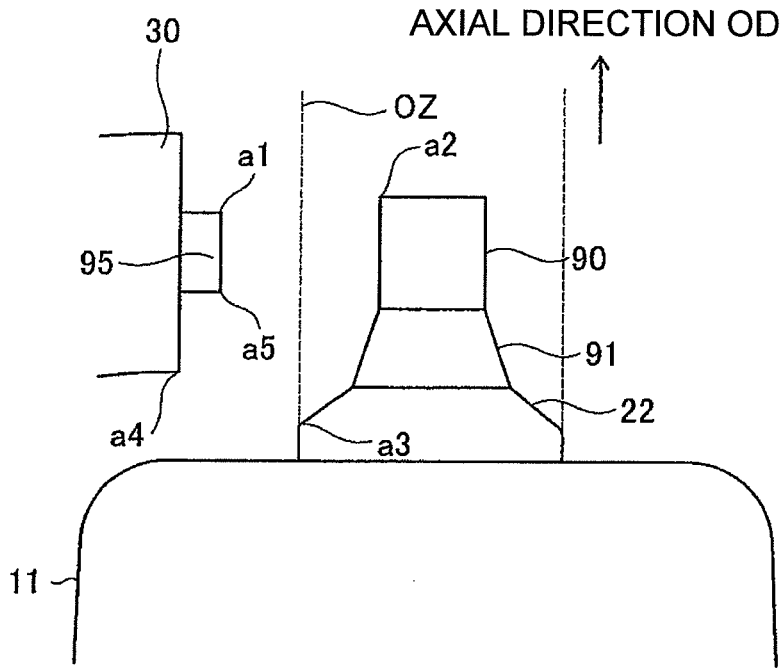
FIGS. 11(A), (B) are diagrams showing a positional relationship among the corner a3, a corner a1, and a corner a5.
Figure 11B:
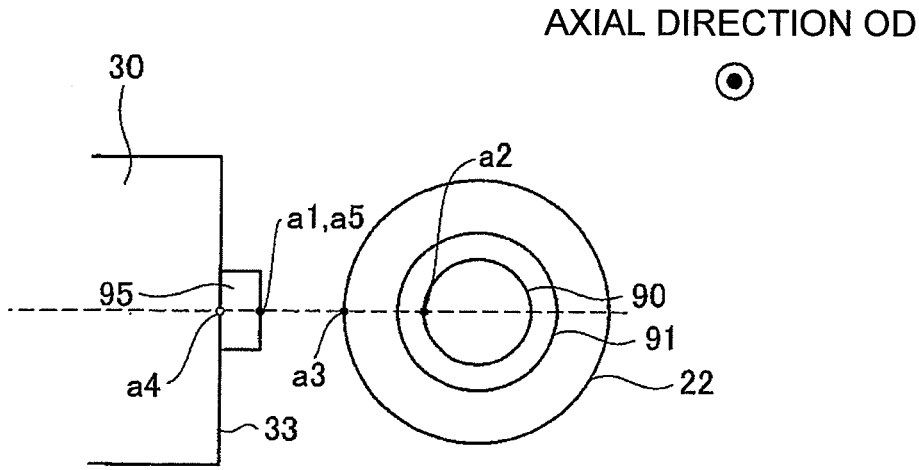

FIG. 11(A) is a diagram showing a positional relationship among the corner a3, the corner a1, and the corner a5. FIG. 11(B) is a view of the vicinity of the leading end of the spark plug 100 when viewed in the axial direction. FIG. 11(A) shows a line OZ extending from the corner a3 along the axial direction OD of the spark plug. The corner a1 and the corner a5 are preferably configured such that the line OZ does not cross the ground electrode tip 95.

So long as the spark plug is configured as mentioned above, the ground electrode tip is not situated in an extension of a line that extends from a corner formed at the starting point, where the diameter of the center electrode is reduced, along the axial line of the spark plug. Therefore, even when fuel adheres to the surface of the center electrode, occurrence of a fuel bridge between the corner formed at the starting point where the diameter of the center electrode is reduced and the ground electrode can be prevented. A failure to make spark discharge in the spark discharge gap, which would otherwise be caused as a result of leakage of an electric current by way of the fuel bridge, can be inhibited.

Figure 12A:
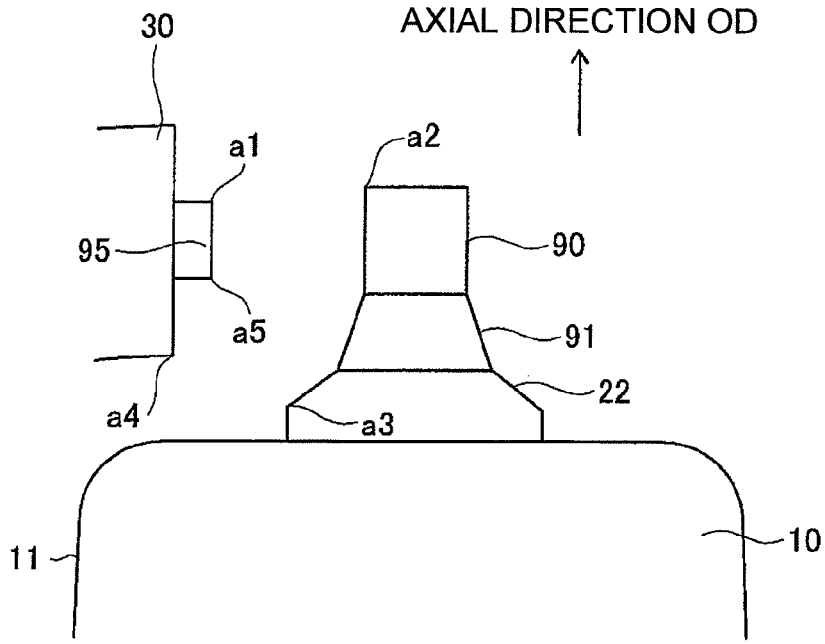
FIG. 12(A) is a diagram showing a vicinity of the leading end of the spark plug 100 of the embodiment.
Figure 12B:
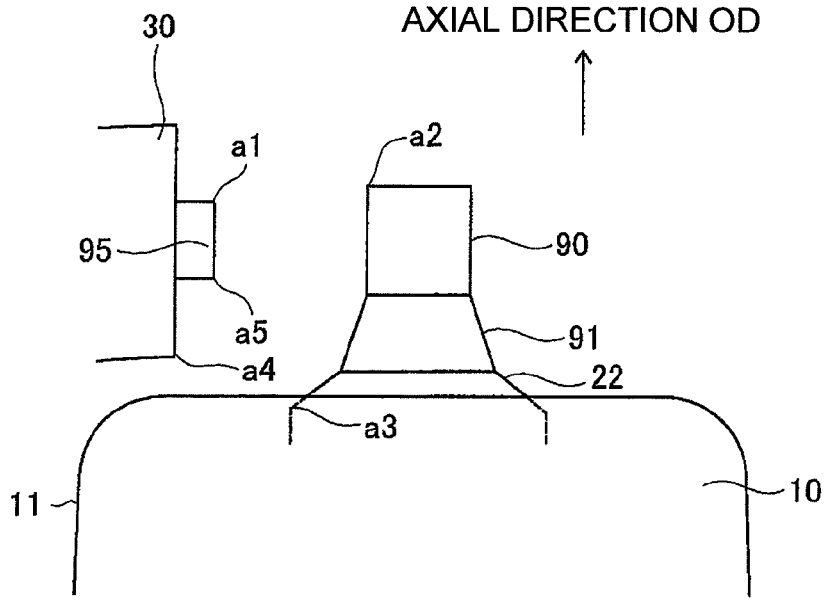
FIG. 12(B) is a diagram showing a vicinity of the leading end of the spark plug 100 of a comparative example.

FIG. 12(A) is a diagram showing a vicinity of a leading end of the spark plug 100 of the embodiment. FIG. 12(B) is a diagram showing a vicinity of the leading end of the spark plug 100 of a comparative example. The corner a3 of the embodiment is exposed from the leading end 11 of the insulator 10. In the meantime, the corner a3 of the comparative example is not exposed from the leading end 11 of the insulator 10. As shown in FIG. 12(A), the corner a3 is preferably exposed from the leading end of the insulator 10.

So long as the spark plug is configured as mentioned above, even in a state where an insulation characteristic of the surface of the insulator is deteriorated as a result of adhesion of carbon resultant from combustion of a mixed air on the surface of the insulator and where electrical conduction is established between the center electrode and the surface of the insulator by means of carbon, generation of a fuel bridge, which would otherwise be caused when the carbon adhering to the leading-end face and the ground electrode, can be prevented and, by extension, current leakage can be prevented.

Figure 13A:
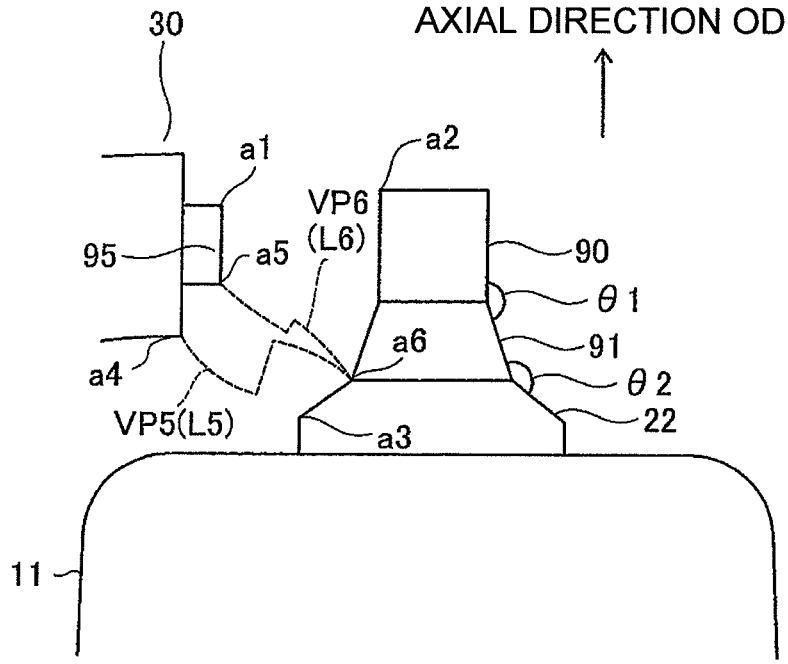
FIGS. 13(A), (B) are enlarged diagrams showing the leading end 22 of the center electrode 20.
Figure 13B:
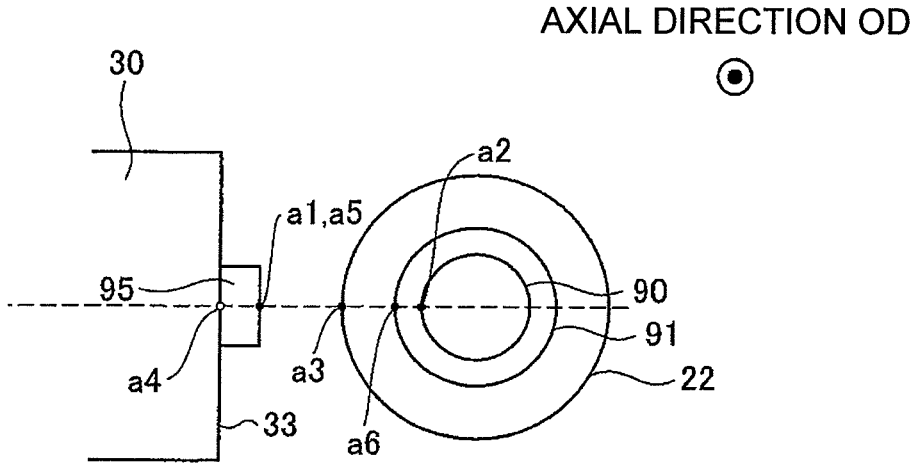

FIG. 13(A) is an enlarged diagram showing the leading end 22 of the center electrode 20. FIG. 13(B) is a view of the vicinity of the leading end of the spark plug 100 when viewed in the axial direction. FIG. 13(A) shows two virtual flying spark paths VP5 and VP6. The fifth virtual flying spark path VP5 is a virtual path achieved when flying sparks develop between the corner a4 of the ground electrode 30 and a corner a6 of the fused portion 91. The sixth virtual flying spark path VP6 is a virtual path achieved when flying spark is produced between the corner a5 of a ground electrode tip 95 and the corner a6 of the used portion 91. The corner a6 is a corner closest to the ground electrode 30, among corners formed in a boundary portion between the center electrode 20 and the fused portion 91. In this specification, the term "corner" is used to cover a recessed portion which does not protrude and which is formed as a result of intersection of two planes. The way to plot the fifth virtual flying spark path VP5 and the sixth virtual flying spark path VP6 is similar to the way to plot the virtual flying spark paths VP1 to VP3 shown in FIG. 5 to FIG. 7.

A length L5 of the fifth virtual flying spark path VP5 and a length L6 of the sixth virtual flying spark path VP6 are compared with each other. When the shorter length is defined as L7, it is preferable for the spark plug to fulfill Relational Expression (7) provided below.

$$L7/L4 \geq 0.5 \tag{7}$$

where L7=min(L5, L6).

So long as the spark plug is configured so as to fulfill Relational Expression (7), development of electric discharge between the fused portion and the ground electrode or the ground-electrode-side noble metal tip can also be inhibited. Therefore, development of electric discharge from a path other than a normal discharge path can further be inhibited.

An angle achieved in a boundary portion between the center electrode tip 90 and the fused portion 91 is taken as θ1. An angle achieved in a boundary portion between the fused portion 91 and the center electrode 20 is taken as θ2. In this case, it is preferable for the spark plug to satisfy Relational Expression (8) and Relational Expression (9) provided below.

$$\theta 1 > \theta 2 \tag{8}$$

$$\theta 1 < 180^\circ \tag{9}$$

So long as the spark plug is configured so as to fulfill Relational Expression (8) and Relational Expression (9), heat conduction of the center electrode tip further to the center electrode by way of the fused portion is effectively performed.

C. Example Test on Flying Spark Path Ratio Lr:

In order to examine a relationship between a shoulder position flying spark ratio (%) and a flying spark path ratio Lr in the spark plug configured as shown in FIG. 3, tests were conducted by use of samples having different flying spark path ratios Lr. The term "shoulder position flying spark ratio" is a ratio at which electric discharge develops from a path (paths extending along the second virtual flying spark path VP2 and the third virtual flying spark path VP3) other than a normal discharge path (e.g., a path running along the first virtual flying spark path VP1). Tests using samples having different gaps G were also conducted for reference.

Figure 14:
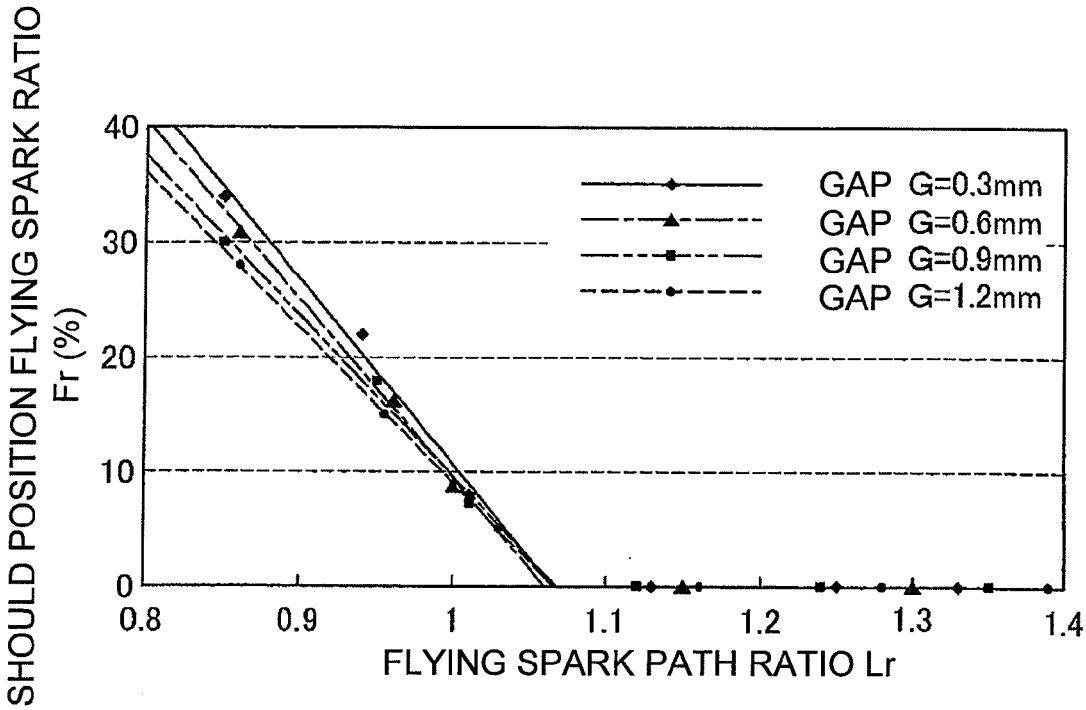
FIG. 14 is a graph showing a relationship between a flying spark path ratio Lr and a shoulder position flying spark ratio Fr.

FIG. 14 is a graph showing a relationship between the flying spark path ratio Lr and the shoulder position flying spark ratio Fr. A vertical axis in FIG. 14 represents the shoulder position flying spark ratio Fr, and a horizontal axis of the same represents the flying spark path ratio Lr. It can be understood from FIG. 14 that, as the flying spark path ratio Lr becomes larger, the shoulder position flying spark ratio Fr becomes smaller.

Further, it can be understood from FIG. 14 that, when the flying spark path ratio Lr is 1.0 or more, the shoulder position flying spark ratio Fr can be reduced to 10% or less. Therefore, it is preferable that the flying spark path ratio Lr is 1.0 or more. It is understood that, when the flying spark path ratio Lr is 1.1 or more, the shoulder position flying spark ratio Fr can be reduced substantially to 0%. Therefore, it is particularly preferable that the flying spark path ratio Lr assumes a value of 1.1 or more. It can be understood that the shoulder position flying spark ratio Fr is less affected by the size of the gap G and greatly depends on the flying spark path ratio Lr.

As mentioned above, so long as the spark plug is configured such that the flying spark path ratio Lr fulfills Relational Expression (1), the shoulder position flying spark ratio Fr can be reduced substantially to a value of 0%, thereby inhibiting generation of electric discharge in a path other than the normal discharge path.

D. Example Test on Curvature Radii of R-Chamfered Portions rf1, rf2:

In order to examine a relationship between curvature radii of the R-chamfered portions fr1, rf2 and the shoulder position flying spark ratio Fr in the spark plug configured as shown in FIG. 8, the test was conducted by use of samples having different curvature radii of the R-chamfered portions fr1, rf2. The test was conducted by preparation of three values (Lr=0.8, 0.9, 1.0) as the flying spark path ratio Lr.

Figure 15:
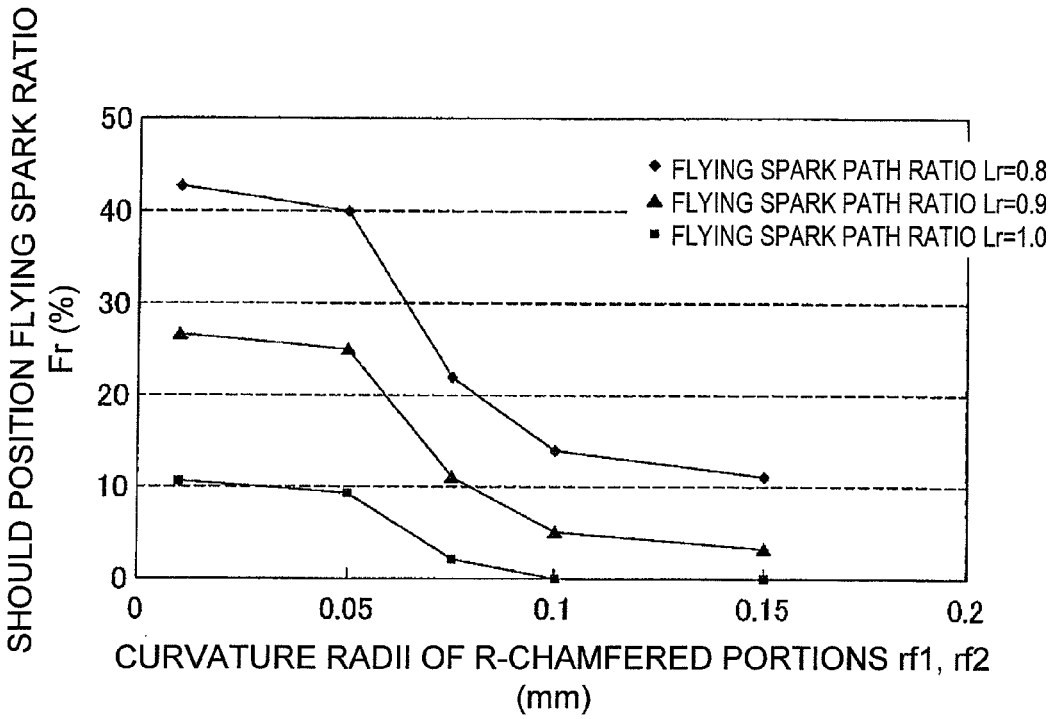
FIG. 15 is a graph showing a relationship between curvature radii of respective R-chamfered portions rf1, rf2 and the shoulder position flying spark ratio Fr.

FIG. 15 is a graph showing a relationship between curvature radii of the R-chamfered portions fr1, rf2 and the shoulder position flying spark ration Fr. A vertical axis of FIG. 15 represents a shoulder position flying spark ratio Fr (%), and a horizontal axis of the same represents curvature radii (mm) of the R-chamfered portions fr1, rf2. It can be understood from FIG. 15 that, as the curvature radii of the R-chamfered portions fr1, fr2 become greater, the shoulder position flying spark ratio Fr becomes smaller. It can also be understood that, even when the curvature radii of the R-chamfered portions fr1, rf2 are identical with each other, the shoulder position flying spark ratio Fr becomes smaller as the flying spark path ratio Lr becomes larger.

It can be understood from FIG. 15 that, when the flying spark path ratio Lr is 0.9 or more and when the curvature radii of the R-chamfered portions fr1, rf2 are 0.1 mm or more, the shoulder position flying spark ratio Fr comes to less than 10%. Therefore, it is preferable that the flying spark path ratio Lr is 0.9 or more and that the curvature radii of the R-chamfered portions fr1, rf2 are 0.1 mm or more.

Further, it can also be understood from FIG. 15 that, when the flying spark path ratio Lr is 1.0 or more and when the curvature radii of the R-chamfered portions fr1, rf2 are 0.05 mm or more, the shoulder position flying spark ratio Fr comes to less than 10%. Therefore, it is preferable that the flying spark path ratio Lr is 1.0 or more and that the curvature radii of the R-chamfered portions fr1, rf2 are 0.05 mm or more.

It can also be understood that, when the flying spark path ratio Lr is 1.0 or more and when the curvature radii of the R-chamfered portions fr1, rf2 are 0.1 mm or more, the shoulder position flying spark ratio Fr comes to 0%. Therefore, it is preferable that the flying spark path ratio Lr is 1.0 or more and that the curvature radii of the R-chamfered portions fr1, rf2 are 0.1 mm or more.

So long as the flying spark path ratio Lr and the curvature radii of the R-chamfered portions fr1, rf2 are defined as mentioned above, development of electric discharge from a path other than a normal path can be inhibited.

E. Example Test on Opposed Volume V:

In order to examine a relationship between the opposed volume V and the amount of increase in gap G achieved after a desk spark test, a desk spark test was conducted by use of seven samples having different opposed volumes V. The term "desk spark test" means a test for evaluating the performance of the spark plug 100 and the state of wear in electrodes by subjecting the spark plug 100 to a tester and repeating electric discharge over a long hour. In the example test, electric discharge was repeated in an atmospheric environment at a pressure of 0.4 MPa and a frequency of 100 Hz.

Figure 16:
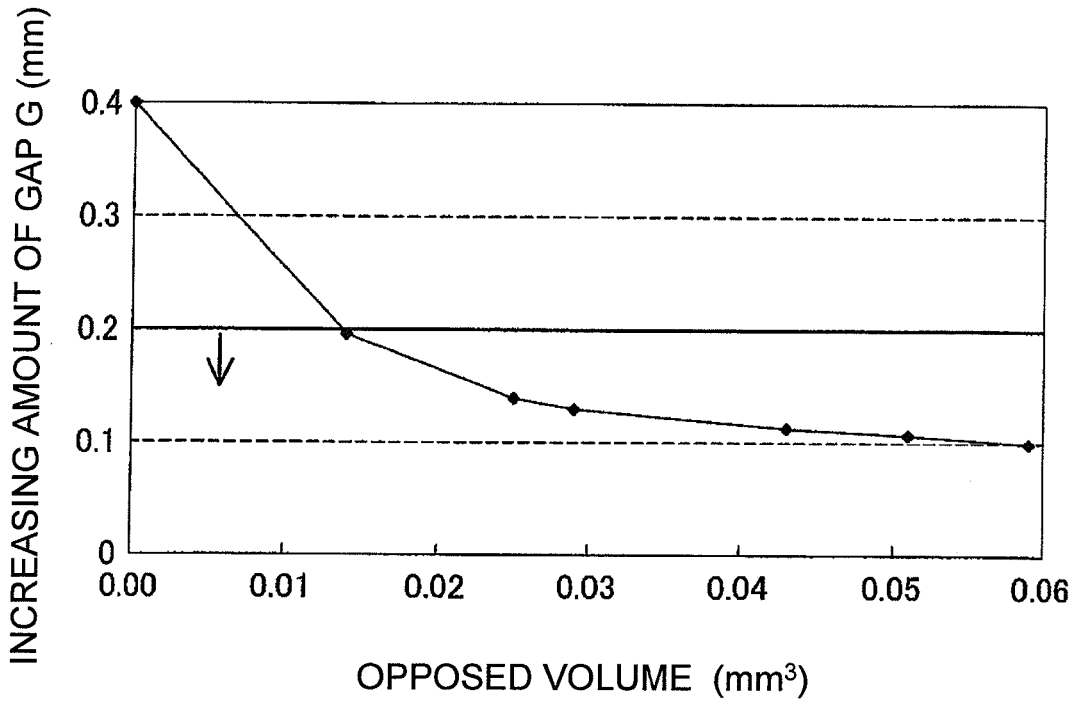
FIG. 16 is a graph showing a relationship between an opposed volume V and an increase in gap G achieved after a test.

FIG. 16 is a graph showing a relationship between the opposed volume V and the amount of increase in gap G achieved after the test. A horizontal axis of FIG. 16 represents an opposed volume V ($mm^3$), and a vertical axis of the same represents the amount (mm) of increase in gap G achieved after the desk spark test was conducted for 250 hrs. It can be understood from FIG. 16 that, as the opposed volume V becomes greater, an increase in gap G achieved after test is smaller. It can also be understood from FIG. 16 that a preferable opposed volume V is 0.015 $mm^3$ or more at which the amount of increase in gap G achieved after the test comes to 0.2 mm or less.

As mentioned above, so long as the spark plug is configured such that the opposed volume V satisfies Relational Expression (6), an increase in gap G that is the shortest distance between the center electrode tip 90 and the ground electrode tip 95 can be inhibited, and durability of the electrodes can be enhanced.

F. Modification:

The present invention is not limited to the above-described embodiment or example and can be implemented in various forms without departing from the substance of the invention; and the following modifications, for instance, are also possible.

Figure 17:
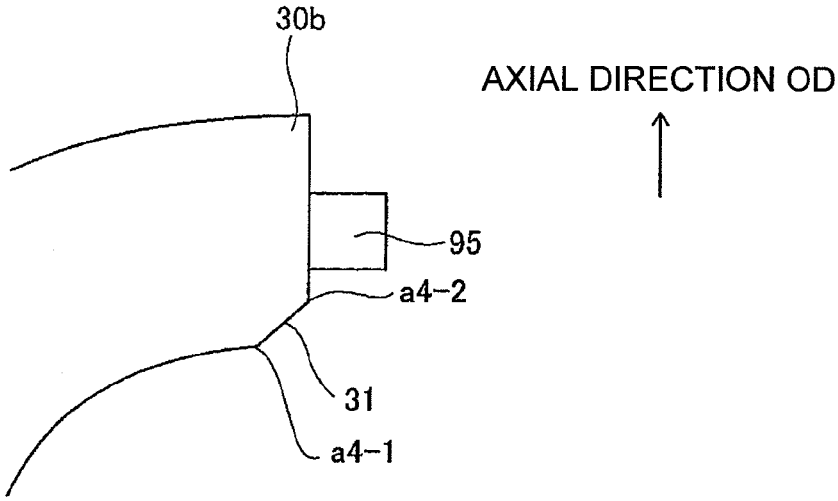
FIG. 17 is a diagram showing the structure of a ground electrode 30*b* of a modification.

FIG. 17 is a diagram showing the configuration of a ground electrode 30*b* of a modification. A tapered portion 31 is provided, in place of the R-chamfered portions, in the ground electrode 30*b* in FIG. 17. Corners a4-1 and a4-2 are formed at both ends of the tapered portion 31. As such a configuration, it is also possible to make the lengths of the virtual flying spark paths other than the normal discharge path longer, thereby inhibiting development of electric discharge from a path other than the normal discharge path. In this case, the second virtual flying spark path VP2 can also be drawn by replacing the corner a4-1 or the corner a4-2, whichever is closer to the corer a3 (FIG. 3), with the corner a4 in FIG. 3. Moreover, a virtual flying spark path from the corner a4-1 and the corner a4-2 to the corner a3 (FIG. 3) can be drawn, and a path having a shorter length can also be defined as the second virtual flying spark path VP2.

Figure 18:
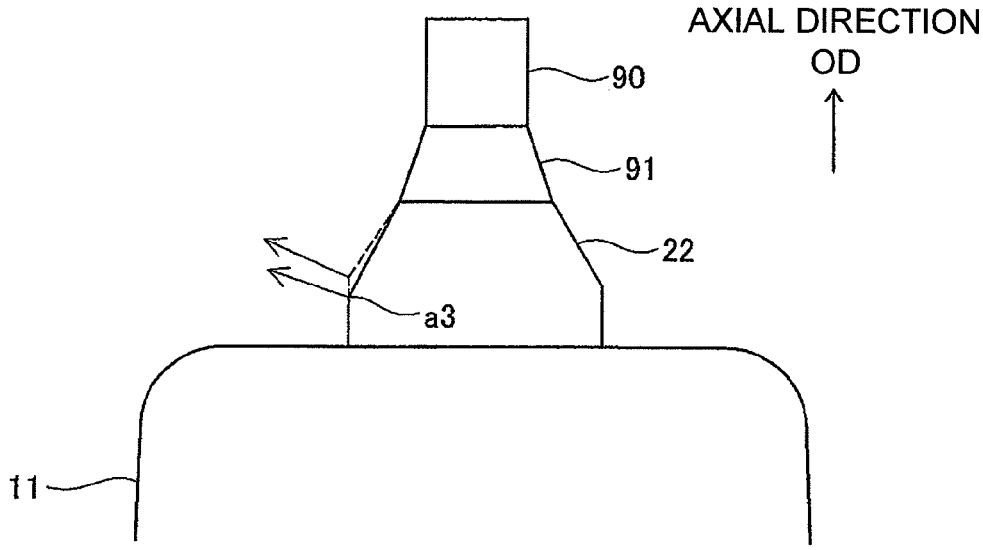
FIG. 18 is a diagram showing a vicinity of the leading end 22 of the center electrode 20 of the modification.

FIG. 18 is a diagram showing a vicinity of the leading end 22 of the center electrode 20 of the modification. In FIG. 18, the angle of the corner a3 is made large. Thus, it is also possible to inhibit development of electric discharge from a path other than the normal discharge path by lengthening the virtual flying spark paths other than the normal discharge path.

The invention claimed is:

1. A spark plug comprising:

a center electrode extending in an axial direction of the spark plug;

a center-electrode-side noble metal tip joined to a leading end of the center electrode;

a fused portion is formed between the center electrode and the center-electrode-side noble metal tip, an obtuse angle achieved in a boundary portion between the center-electrode-side noble metal tip and the fused portion is taken as θ1, and an obtuse angle achieved in a boundary portion between the fused portion and the center electrode is taken as θ2, a relational expression of θ1>θ2 and a relational expression of θ1<180° are fulfilled;

a ground electrode opposing a side surface of the center-electrode-side noble metal tip; and a ground-electrode-side noble metal tip joined to a distal end of the ground electrode, wherein:

of corners of a distal end of the ground-electrode-side noble metal tip, a corner closest toward a leading end direction of the center-electrode-side noble metal tip is taken as a first corner;

of corners of the leading end of the center-electrode-side noble metal tip, a corner closest to the ground-electrode-side noble metal tip is taken as a second corner;

of corners formed at a starting point where a diameter of the center electrode is reduced, a corner closest to the ground electrode is taken as a third corner;

of the corners of the ground electrode, a corner closest to the third corner is taken as a fourth corner;

of the corners on the distal end of the ground-electrode-side noble metal tip, a corner closest to the third corner is taken as a fifth corner;

of corners formed in a boundary portion between the center electrode and the fused portion, a corner closest to the ground electrode is taken as a sixth corner;

a virtual flying spark path established between any two of the corners is defined, on condition that:

a line passing through a vertex of one corner and bisecting the one corner is taken as a first line, a line passing through a vertex of another corner and bisecting the another corner is taken as a second line, a circular arc tangent to the first line and having end points at the vertex of the one corner and the vertex of the another corner is taken as a first circular arc, and a circular arc tangent to the second line and having end points at the vertex of the one corner and the vertex of the another corner is taken as a second circular arc, as a combination of: a path extending along the first circular arc which connects the vertex of the one corner to a middle point of the first circular arc; a straight path that connects the middle point of the first circular arc to a middle point of the second circular arc; and a path extending along the second circular arc which connects the middle point of the second circular arc to the vertex of the another corner; and a relational expression of L4/L1≥1.1 is fulfilled on condition that:

a length of a virtual flying spark path defined between the first corner and the second corner is taken as L1, a length of a virtual flying spark path defined between the third corner and the fourth corner is taken as L2, a length of a virtual flying spark path defined between the third corner and the fifth corner is taken as L3, and L2 or L3, whichever is shorter, is taken as L4;

a relational expression of L7/L4≥0.5 is fulfilled on condition that:

a length of a virtual flying spark path defined between the fourth corner and the sixth corner is taken as L5, a length of a virtual flying spark path defined between the fifth corner and the sixth corner is taken as L6, and L5 or L6, whichever is shorter, is taken as L7.

2. The spark plug according to claim 1, wherein the first corner and the second corner are configured such that a first half line extending from the vertex of the first corner as a starting point toward an outside of the first corner and bisecting the first corner and a second half line extending from the vertex of the second corner as a starting point toward an outside of the second corner and bisecting the second corner cross each other;

the third corner and the fourth corner are configured, when L2≤L3, such that a third half line extending from the vertex of the third corner as a starting point toward an outside of the third corner and bisecting the third corner and a fourth half line extending from the vertex of the fourth corner as a starting point toward an outside of the fourth corner and bisecting the fourth corner do not cross each other; and the third corner and the fifth corner are configured, when L3<L2, such that the third half line and a fifth half line extending from the vertex of the fifth corner as a starting point toward an outside of the fifth corner and bisecting the fifth corner do not cross each other.

3. The spark plug according to claim 1, wherein, on condition that:

a virtual plane parallel to the distal end of the ground-electrode-side noble metal tip which overlaps the center-electrode-side noble metal tip and spaced 0.1 mm away from a point on the center-electrode-side noble metal tip closest to the distal end of the ground-electrode-side noble metal tip is taken as a first virtual plane, a volume of a discharge contribution portion that is a part of the center-electrode-side noble metal tip to be cut by the first virtual plane and that overlaps the distal end of the ground-electrode-side noble metal tip when the center-electrode-side noble metal tip is projected on the distal end of the ground-electrode-side noble metal tip is taken as V1, a virtual plane parallel to the distal end of the ground-electrode-side noble metal tip, which overlaps the ground-electrode-side noble metal tip and spaced 0.1 mm away from the distal end of the ground-electrode-side noble metal tip is taken as a second virtual plane, and a volume of a discharge contribution portion that is a part of the ground-electrode-side noble metal tip to be cut by the second virtual plane and that overlaps the discharge contribution portion when the discharge contribution portion is projected on the distal end of the ground-electrode-side noble metal tip is taken as V2, a relational expression of V1+V2≥0.015 $mm^3$ is fulfilled.

4. The spark plug according to claim 1, wherein the first corner and the fifth corner are configured such that a line extending from the third corner along the axial direction of the spark plug does not cross the ground-electrode-side noble metal tip.

5. The spark plug according to claim 1, wherein the third corner is exposed from a leading end of a substantially-cylindrical insulator provided on an outer periphery of the center electrode.

6. A spark plug comprising:

a center electrode extending in an axial direction of the spark plug;

a center-electrode-side noble metal tip joined to a leading end of the center electrode;

a fused portion is formed between the center electrode and the center-electrode-side noble metal tip, an obtuse angle achieved in a boundary portion between the center-electrode-side noble metal tip and the fused portion is taken as θ1, and an obtuse angle achieved in a boundary portion between the fused portion and the center electrode is taken as θ2, a relational expression of θ1>θ2 and a relational expression of θ1<180° are fulfilled;

a ground electrode opposing a side surface of the center-electrode-side noble metal tip; and a ground-electrode-side noble metal tip joined to a distal end of the ground electrode, wherein of corners of a distal end of the ground-electrode-side noble metal tip, a corner closest toward a leading end direction of the center-electrode-side noble metal tip is taken as a first corner;

of corners of a leading end of the center-electrode-side noble metal tip, a corner closest to the ground-electrode-side noble metal tip is taken as a second corner;

of R-chamfered portions formed at a starting point where a diameter of the center electrode is reduced, an R-chamfered portion closest to the ground electrode is taken as a first R-chamfered portion;

a virtual corner formed by a point of intersection of two lines sandwiching the first R-chamfered portion and the two lines is taken as a third corner;

of R-chamfered portions made between a distal end and a side surface of the ground electrode, an R-chamfered portion closest to the third corner is taken as a second R-chamfered portion;

a virtual corner formed by a point of intersection of two lines sandwiching the second R-chamfered portion and the two lines is taken as a fourth corner;

of corners of a distal end of the ground-electrode-side noble metal tip, a corner closest to the third corner is taken as a fifth corner;

of corners formed in a boundary portion between the center electrode and the fused portion, a corner closest to the ground electrode is taken as a sixth corner;

a virtual flying spark path established between any two of the corners is defined, on condition that:

a line passing through a vertex of one corner and bisects the one corner is taken as a first line, a line passing through a vertex of another corner and bisects the another corner is taken as a second line, a circular arc tangent to the first line and having end points at the vertex of the one corner and the vertex of the another corner is taken as a first circular arc, and a circular arc tangent to the second line and having end points at the vertex of the one corner and the vertex of the another corner is taken as a second circular arc, as a combination of: a path extending along the first circular arc which connects the vertex of the one corner to a middle point of the first circular arc; a straight path that connects a middle point of the first circular arc to a middle point of the second circular arc; and a path extending along the second circular arc which connects the middle point of the second circular arc to the vertex of the another corner; and a relational expression of L4/L1≥0.9 is fulfilled, and a curvature radius of the first R-chamfered portion and a curvature radius of the second R-chamfered portion are 0.1 mm or more, on condition that:

a length of a virtual flying spark path defined between the first corner and the second corner is taken as L1, a length of a virtual flying spark path defined between the third corner and the fourth corner is taken as L2, a length of a virtual flying spark path defined between the third corner and the fifth corner is taken as L3, and L2 or L3, whichever is shorter, is taken as L4;

a relational expression of L7/L4≥0.5 is fulfilled on condition that:

a length of a virtual flying spark path defined between the fourth corner and the sixth corner is taken as L5, a length of a virtual flying spark path defined between the fifth corner and the sixth corner is taken as L6, and L5 or L6, whichever is shorter, is taken as L7.

7. The spark plug according to claim 6, wherein, on condition that:

a virtual plane parallel to the distal end of the ground-electrode-side noble metal tip which overlaps the center-electrode-side noble metal tip and spaced 0.1 mm away from a point on the center-electrode-side noble metal tip closest to the distal end of the ground-electrode-side noble metal tip is taken as a first virtual plane, a volume of a discharge contribution portion that is a part of the center-electrode-side noble metal tip to be cut by the first virtual plane and that overlaps the distal end of the ground-electrode-side noble metal tip when the center-electrode-side noble metal tip is projected on the distal end of the ground-electrode-side noble metal tip is taken as V1, a virtual plane parallel to the distal end of the ground-electrode-side noble metal tip, which overlaps the ground-electrode-side noble metal tip and spaced 0.1 mm away from the distal end of the ground-electrode-side noble metal tip is taken as a second virtual plane, and a volume of a discharge contribution portion that is a part of the ground-electrode-side noble metal tip to be cut by the second virtual plane and that overlaps the discharge contribution portion when the discharge contribution portion is projected on the distal end of the ground-electrode-side noble metal tip is taken as V2, a relational expression of V1+V2≥0.015 $mm^3$ is fulfilled.

8. The spark plug according to claim 6, wherein the first corner and the fifth corner are configured such that a line extending from the third corner along the axial direction of the spark plug does not cross the ground-electrode-side noble metal tip.

9. The spark plug according to claim 6, wherein the third corner is exposed from a leading end of a substantially-cylindrical insulator provided on an outer periphery of the center electrode.

10. A spark plug comprising:

a center electrode extending in an axial direction of the spark plug;

a center-electrode-side noble metal tip joined to a leading end of the center electrode;

a fused portion is formed between the center electrode and the center-electrode-side noble metal tip, an obtuse angle achieved in a boundary portion between the center-electrode-side noble metal tip and the fused portion is taken as θ1, and an obtuse angle achieved in a boundary portion between the fused portion and the center electrode is taken as θ2, a relational expression of θ1>θ2 and a relational expression of θ1<180° are fulfilled;

a ground electrode opposing a side surface of the center-electrode-side noble metal tip; and a ground-electrode-side noble metal tip joined to a distal end of the ground electrode, wherein:

of corners of a distal end of the ground-electrode-side noble metal tip, a corner closest toward a leading end direction of the center-electrode-side noble metal tip is taken as a first corner;

of corners of a leading end of the center-electrode-side noble metal tip, a corner closest to the ground-electrode-side noble metal tip is taken as a second corner;

of R-chamfered portions formed at a starting point where a diameter of the center electrode is reduced, an R-chamfered portion closest to the ground electrode is taken as a first R-chamfered portion;

a virtual corner formed by a point of intersection of two lines sandwiching the first R-chamfered portion and the two lines is taken as a third corner;

of R-chamfered portions formed between a distal end and a side surface of the ground electrode, an R-chamfered portion closest to the third corner is taken as a second R-chamfered portion;

a virtual corner formed of a point of intersection of two lines sandwiching the second R-chamfered portion and the two lines is taken as a fourth corner;

of corners on a distal end of the ground-electrode-side noble metal tip, a corner closest to the third corner is taken as a fifth corner;

of corners formed in a boundary portion between the center electrode and the fused portion, a corner closest to the ground electrode is taken as a sixth corner;

a virtual flying spark path established between any two of the corners is defined, on condition that:

a line passing through a vertex of one corner and bisecting the one corner is taken as a first line, a line passing through a vertex of another corner and bisecting the another corner is taken as a second line, a circular arc tangent to the first line and having end points at the vertex of the one corner and the vertex of the another corner is taken as a first circular arc, and a circular arc tangent to the second line and having end points at the vertex of the one corner and the vertex of the another corner is taken as a second circular arc, as a combination of: a path extending along the first circular arc which connects the vertex of the one corner to a middle point of the first circular arc; a straight path that connects a middle point of the first circular arc to a middle point of the second circular arc; and a path extending along the second circular arc which connects the middle point of the second circular arc to the vertex of the another corner;

a relational expression of $L4/L1 \geq 1.0$ is fulfilled on condition that:

a length of a virtual flying spark path defined between the first corner and the second corner is taken as L1, a length of a virtual flying spark path defined between the third corner and the fourth corner is taken as L2, a length of a virtual flying spark path defined between the third corner and the fifth corner is taken as L3, and L2 or L3, whichever is shorter, is taken as L4;

a relational expression of $L7/L4 \geq 0.5$ is fulfilled on condition that:

a length of a virtual flying spark path defined between the fourth corner and the sixth corner is taken as L5, a length of a virtual flying spark path defined between the fifth corner and the sixth corner is taken as L6, and L5 or L6, whichever is shorter, is taken as L7; and a curvature radius of the first R-chamfered portion and a curvature radius of the second R-chamfered portion are 0.05 mm or more.

11. The spark plug according to claim 10, wherein the curvature radius of the first R-chamfered portion and the curvature radius of the second R-chamfered portion are 0.1 mm or more.

12. The spark plug according to claim 10, wherein, on condition that:

a virtual plane parallel to the distal end of the ground-electrode-side noble metal tip which overlaps the center-electrode-side noble metal tip and spaced 0.1 mm away from a point on the center-electrode-side noble metal tip closest to the distal end of the ground-electrode-side noble metal tip is taken as a first virtual plane, a volume of a discharge contribution portion that is a part of the center-electrode-side noble metal tip to be cut by the first virtual plane and that overlaps the distal end of the ground-electrode-side noble metal tip when the center-electrode-side noble metal tip is projected on the distal end of the ground-electrode-side noble metal tip is taken as V1, a virtual plane parallel to the distal end of the ground-electrode-side noble metal tip, which overlaps the ground-electrode-side noble metal tip and spaced 0.1 mm away from the distal end of the ground-electrode-side noble metal tip is taken as a second virtual plane, and a volume of a discharge contribution portion that is a part of the ground-electrode-side noble metal tip to be cut by the second virtual plane and that overlaps the discharge contribution portion when the discharge contribution portion is projected on the distal end of the ground-electrode-side noble metal tip is taken as V2, a relational expression of $V1+V2 \geq 0.015\ mm^3$ is fulfilled.

13. The spark plug according to claim 10, wherein the first corner and the fifth corner are configured such that a line extending from the third corner along the axial direction of the spark plug does not cross the ground-electrode-side noble metal tip.

14. The spark plug according to claim 10, wherein the third corner is exposed from a leading end of a substantially-cylindrical insulator provided on an outer periphery of the center electrode.

* * * * *